US010113544B2

(12) United States Patent
Robison et al.

(10) Patent No.: US 10,113,544 B2
(45) Date of Patent: Oct. 30, 2018

(54) LONG-STROKE PUMPING UNIT

(71) Applicant: Weatherford Technology Holdings, LLC, Houston, TX (US)

(72) Inventors: Clark E. Robison, Tomball, TX (US); Jeffrey John Lembcke, Cypress, TX (US); Victoria M. Pons, Katy, TX (US); William Kevin Hall, Katy, TX (US); John Edward Stachowiak, Jr., Houston, TX (US); Benson Thomas, Pearland, TX (US); Sean M. Christian, Sparrows Point, MD (US); Bryan A. Paulet, Spring, TX (US); Hermann Basler, Stony Plain (CA)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 15/051,060

(22) Filed: Feb. 23, 2016

(65) Prior Publication Data

US 2016/0245276 A1 Aug. 25, 2016

Related U.S. Application Data

(60) Provisional application No. 62/137,524, filed on Mar. 24, 2015, provisional application No. 62/119,305, filed on Feb. 23, 2015.

(51) Int. Cl.
*F04B 47/02* (2006.01)
*F04B 49/20* (2006.01)
(Continued)

(52) U.S. Cl.
CPC ..... *F04B 49/20* (2013.01); *E21B 43/126* (2013.01); *E21B 43/127* (2013.01);
(Continued)

(58) Field of Classification Search
CPC .. E21B 43/126; E21B 43/127; E21B 47/0008; E21B 2043/125
(Continued)

(56) References Cited

U.S. PATENT DOCUMENTS 2,683,379 A 7/1954 Strandgren
3,917,092 A 11/1975 McGinnis
(Continued)

FOREIGN PATENT DOCUMENTS

CN 102817587 A 12/2012
GB 2482672 A 2/2012
(Continued)

OTHER PUBLICATIONS

PCT International Search Report and Written Opinion dated Nov. 22, 2016, for International Patent Application No. PCT/2016/019121.
(Continued)

*Primary Examiner* — Taras P Bemko
(74) *Attorney, Agent, or Firm* — Patterson + Sheridan, LLP

(57) ABSTRACT

A long-stroke pumping unit for driving rod includes a tower and a counterweight assembly movable along the tower. A crown is mounted atop the tower, and a sprocket is supported by the crown and rotatable relative to the crown. A belt connects the counterweight assembly to the rod. The unit further includes a motor having a stator mounted to the crown and a rotor torsionally connected to the sprocket. A sensor is used to detect a position of the counterweight assembly. The pumping unit may include a dynamic control system for controlling a speed of a motor.

19 Claims, 15 Drawing Sheets

(51) Int. Cl.
*E21B 43/12* (2006.01)
*E21B 47/00* (2012.01)
*F04B 47/14* (2006.01)

(52) U.S. Cl.
CPC ..... *E21B 47/0008* (2013.01); *F04B 47/14* (2013.01); *E21B 2043/125* (2013.01)

(58) Field of Classification Search
USPC ..... 166/75.11
See application file for complete search history.

(56) References Cited

U.S. PATENT DOCUMENTS 4,647,050 A 3/1987 Johnson
4,916,959 A 4/1990 Lively
4,932,253 A 6/1990 McCoy
5,020,640 A 6/1991 Nederbragt
5,196,770 A 3/1993 Champs et al.
5,206,652 A * 4/1993 Hoyt ..... G01S 15/10 342/52
5,281,100 A * 1/1994 Diederich ..... E21B 43/127 417/18
5,385,514 A 1/1995 Dawe
5,404,767 A 4/1995 Sutherland
5,406,482 A 4/1995 McCoy et al.
5,440,183 A 8/1995 Denne
5,540,095 A 7/1996 Sherman et al.
6,011,508 A 1/2000 Perreault et al.
6,101,952 A 8/2000 Thornton et al.
6,343,656 B1 2/2002 Vazquez et al.
6,499,701 B1 12/2002 Thornton et al.
6,508,132 B1 1/2003 Lohr et al.
6,578,495 B1 6/2003 Yitts et al.
6,606,569 B1 8/2003 Potts
6,770,004 B1 8/2004 Lofgren et al.
6,851,476 B2 2/2005 Gray et al.
6,983,701 B2 1/2006 Thornton et al.
7,178,600 B2 2/2007 Luke et al.
7,290,476 B1 11/2007 Glasson
7,373,971 B2 5/2008 Montgomery
7,530,799 B2 5/2009 Smith
7,579,941 B2 8/2009 Cleveland et al.
7,857,043 B2 12/2010 Ali-Zada
8,036,829 B2 10/2011 Gibbs et al.
8,256,579 B2 9/2012 Jia
8,328,527 B2 12/2012 Ehimeakhe
8,616,134 B2 12/2013 King et al.
8,624,699 B2 1/2014 Hunter et al.
8,849,954 B2 9/2014 Kim
8,851,860 B1 10/2014 Mail
8,858,187 B2 10/2014 Lane
2005/0235751 A1* 10/2005 Zarabadi ..... G01P 15/0802 73/514.01
2006/0024177 A1* 2/2006 Robison ..... F04B 47/04 417/390
2008/0018603 A1 1/2008 Baraz et al.
2012/0020808 A1 1/2012 Lawson et al.
2013/0186638 A1 7/2013 Filippov et al.
2014/0069720 A1 3/2014 Gray
2014/0312716 A1 10/2014 Hunter et al.
2015/0337648 A1 11/2015 Zippel et al.

FOREIGN PATENT DOCUMENTS

WO 9321442 A1 10/1993
WO 2013131178 A1 9/2013
WO 2014/182272 A1 11/2014

OTHER PUBLICATIONS

Weatherford; Rotaflex Long-Stroke Pumping Units; Artificial Lift Systems; date unknown; 17 total pages.
Analog Devices; Data Sheet; Precision ±1.7 g, ±5 g, ±18 g Single-/Dual-Axis iMEMS Accelerometer; 2004-2014; 16 total pages.
Dr. Richard Thornton; Elevator World; Linear Synchronous Motors for Elevators dated Sep. 2006; 2 total pages.
Weatherford; Production Optimization; Stainless Steel Polished-Rod Load Cell dated 2008; 2 total pages.
Wieler, et al.; Elevator World; Linear Synchronous Motor Elevators Become a Reality; dated May 2012; 4 total pages.
MagneMotion; LSM Elevators; White Paper dated 2013; 2 total pages.
Weatherford; Rotaflex Long-Stroke Pumping Units; Proven Technology for Deep, Challenging, and High-Volume Wells; dated 2014; 24 total pages.

* cited by examiner 8
1k
8r
8b
8s
8d
8p
9
7
10g
10
10b
10w
19k
19w
19b
19
19t
22k
22
22f
11
9
20
15
15p
PLC
15v
15h
15a
15m
17
16
18
21
12,15d
1
1r
2
15f
13
2b
4p
5
2h
3
14
2c
4s
2p
2w
6

LONG-STROKE PUMPING UNIT

BACKGROUND OF THE DISCLOSURE

Field of the Disclosure

The present disclosure generally relates to a long-stroke pumping unit. The present disclosure also relates to a dynamic control system for a long-stroke pumping unit.

Description of the Related Art

To obtain hydrocarbon fluids, a wellbore is drilled into the earth to intersect a productive formation. Upon reaching the productive formation, an artificial lift system is often necessary to carry production fluid (e.g., hydrocarbon fluid) from the productive formation to a wellhead located at a surface of the earth. A sucker rod lifting system is a common type of artificial lift system.

The sucker rod lifting system generally includes a surface drive mechanism, a sucker rod string, and a downhole pump. Fluid is brought to the surface of the wellbore by reciprocating pumping action of the drive mechanism attached to the rod string. Reciprocating pumping action moves a traveling valve on the pump, loading it on the downstroke of the rod string and lifting fluid to the surface on the upstroke of the rod string. A standing valve is typically located at the bottom of a barrel of the pump which prevents fluid from flowing back into the well formation after the pump barrel is filled and during the downstroke of the rod string. The rod string provides the mechanical link of the drive mechanism at the surface to the pump downhole.

On any sucker rod lifting system, the dynamics of the rod string and the operation of the drive mechanism must be matched in order to prolong the service life of the lifting system. Conventionally, the combination of the output of a load cell connected to the rod string and software is used to determine certain operational characteristics of the rod dynamics and the downhole pump system. The operation of the surface drive mechanism is then controlled to achieve an optimum efficiency. This is a control philosophy that is limited in scope because the geometry of the drive mechanism is assumed to follow conventional pump-jack unit designs and certain rod dynamics are assumed based on historical values. This control philosophy is ill-suited for application to long-stroke pumping units because the operational geometry of the unit is different, particularly for the case of hydraulic pump-jacks where the geometry is pure reciprocation.

Also, long-stroke pumping units generally include a rotary motor, a gear box reducer driven by the motor, a chain and carriage linking the reducer to a counterweight assembly, and a belt connecting the counterweight assembly to the rod string. This type of drive mechanism is not very responsive to speed changes of the rod string. Gear-driven pumping units possess inertia from previous motion so that it is difficult to stop the units or change the direction of rotation of the units quickly. Therefore, jarring (and resultant breaking/stretching) of the rod string results upon the turnaround unless the speed of the rod string during the upstroke and downstroke is greatly decreased at the end of the upstroke and downstroke, respectively. Decreasing of the speed of the rod string for such a great distance of the upstroke and downstroke decreases the speed of fluid pumping, thus increasing the cost of the well.

Should the sucker rod string fail, there is a potential that the counterweight assembly will free fall and damage various parts of the pumping unit as it crashes under the force of gravity. The sudden acceleration of the counterweight assembly may not be controllable using the existing long-stroke pumping unit.

SUMMARY OF THE DISCLOSURE

The present disclosure generally relates to a dynamic control system for a long-stroke pumping unit. In one embodiment, a pumping unit includes a prime mover for reciprocating a rod string; and a dynamic control system for controlling a speed of the prime mover. The control system includes a load cell for measuring force exerted on the rod string; a sensor for detecting position of the rod string; an accelerometer for measuring vibration of the rod string or of a production string; a meter for measuring power consumed by the prime mover; and a controller. The controller is operable to determine position of and load on a downhole pump connected to the rod string and the production string; determine acceptability of two or more parameters of the pumping unit; select a prime objective based on a hierarchy of the parameters and the acceptability of the parameters; and determine an upstroke speed, a downstroke speed, and turnaround accelerations and decelerations for the prime objective.

In another embodiment, a long-stroke pumping unit includes a tower; a counterweight assembly movable along the tower; a crown mounted atop the tower; a sprocket supported by the crown and rotatable relative thereto; and a belt. The belt has a first end connected to the counterweight assembly, extends over and meshes with the sprocket, and has a second end connectable to a rod string. The unit further includes a motor having a stator mounted to the crown and a rotor torsionally connected to the sprocket; and a sensor for detecting position of the counterweight assembly.

In another embodiment, a long-stroke pumping unit includes a tower; a crown mounted atop the tower; a spool supported by the crown and rotatable relative thereto; and a belt. The belt has an upper end mounted to the spool, is wrapped around the spool, and has a lower end connectable to a rod string. The unit further includes a motor having a stator mounted to the crown and a rotor torsionally connected to the spool; and a torsion spring having one end connected to the crown and the other end connected to the spool for biasing the spool toward wrapping of the belt thereon.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figures 1A, 1B:
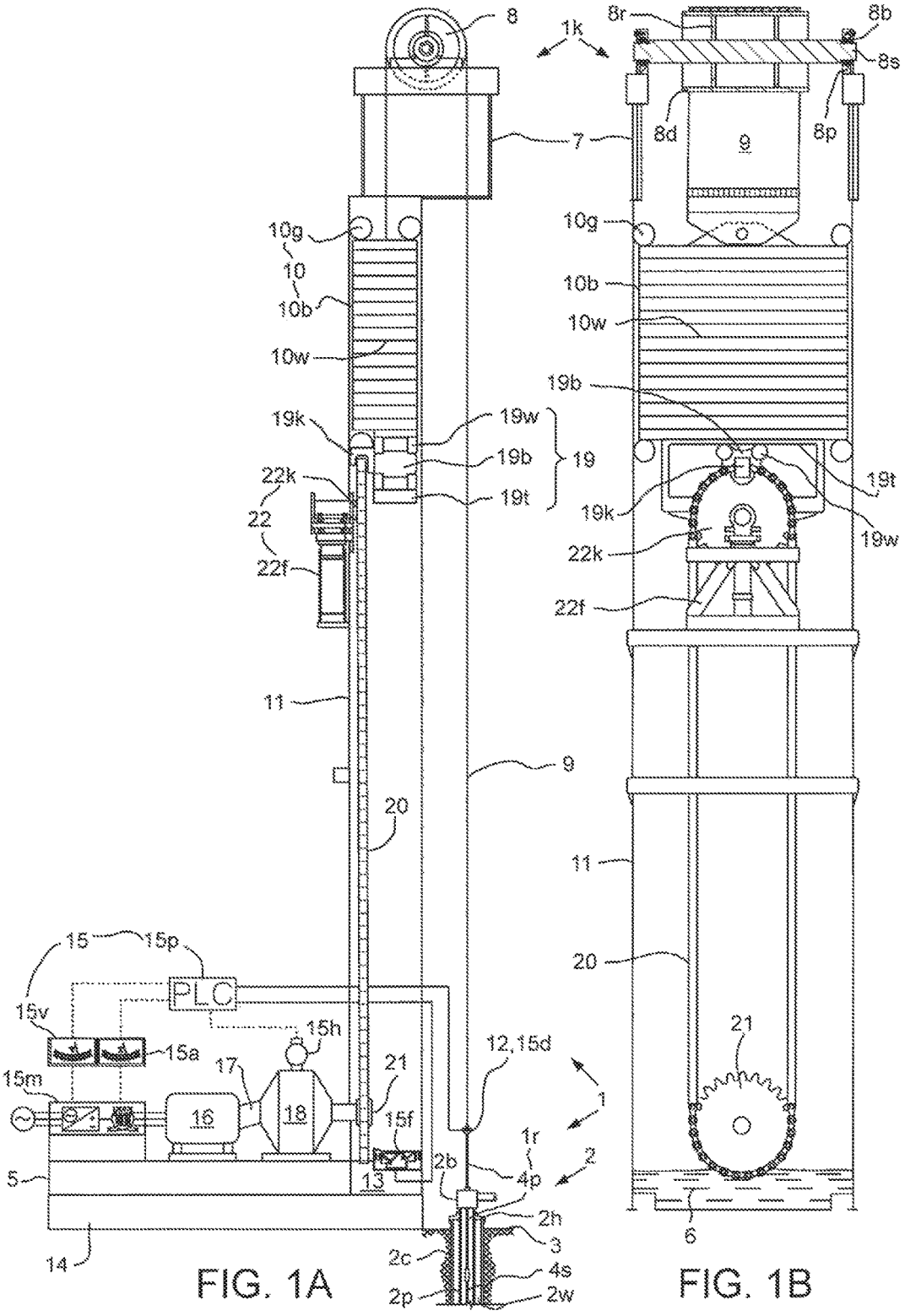
FIGS. 1A and 1B illustrate a long-stroke pumping unit having a dynamic control system, according to one embodiment of the present disclosure.

FIGS. 1A and 1B illustrate a long-stroke pumping unit 1*k* having a dynamic control system 15, according to one embodiment of the present disclosure. The long-stroke pumping unit 1*k* may be part of an artificial lift system 1 further including a rod string 1*r* and a downhole pump (not shown). In this respect, the long-stroke pumping unit 1*k* is a type of reciprocating rod pumping unit. The artificial lift system 1 may be operable to pump production fluid (not shown) from a hydrocarbon bearing formation (not shown) intersected by a well 2. The well 2 may include a wellhead 2*h* located adjacent to a surface 3 of the earth and a wellbore 2*w* extending from the wellhead. The wellbore 2*w* may extend from the surface 3 through a non-productive formation and through the hydrocarbon-bearing formation (aka reservoir).

A casing string 2*c* may extend from the wellhead 2*h* into the wellbore 2*w* and be sealed therein with cement (not shown). A production string 2*p* may extend from the wellhead 2*h* and into the wellbore 2*w*. The production string 2*p* may include a string of production tubing and the downhole pump connected to a bottom of the production tubing. The production tubing may be hung from the wellhead 2*h*.

The downhole pump may include a tubular barrel with a standing valve located at the bottom that allows production fluid to enter from the wellbore 2*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 1*r* for reciprocation thereby. During the upstroke of the plunger, the traveling valve may be closed and any fluid above the plunger in the production tubing may be lifted towards the surface 3. Meanwhile, the standing valve may open and allow fluid to enter the pump barrel from the wellbore 2*w*. During the downstroke of the plunger, the traveling valve may be open and the standing valve may be closed to transfer the fluid from the pump barrel to the plunger.

The rod string 1*r* may extend from the long-stroke pumping unit 1*k*, through the wellhead 2*h*, and into the wellbore 2*w*. The rod string 1*r* may include a jointed or continuous sucker rod string 4*s* and a polished rod 4*p*. The polished rod 4*p* may be connected to an upper end of the sucker rod string 4*s* and the pump plunger may be connected to a lower end of the sucker rod string, such as by threaded couplings.

A production tree 53 (FIG. 6) may be connected to an upper end of the wellhead 2*h* and a stuffing box 2*b* may be connected to an upper end of the production tree, such as by flanged connections. The polished rod 4*p* may extend through the stuffing box 2*b*. The stuffing box 2*b* may have a seal assembly (FIG. 6) for sealing against an outer surface of the polished rod 4*p* while accommodating reciprocation of the rod string 1*r* relative to the stuffing box.

The long-stroke pumping unit 1*k* may include a skid 5, one or more ladders and platforms (not shown), a standing strut (not shown), a crown 7, a drum assembly 8, a load belt 9, one or more wind guards (not shown), a counterweight assembly 10, a tower 11, a hanger bar 12, a tower base 13, a foundation 14, the dynamic control system 15, a prime mover, such as an electric motor 16, a rotary linkage 17, a reducer 18, a carriage 19, a chain 20, a drive sprocket 21, and a chain idler 22. The control system 15 may include a programmable logic controller (PLC) 15*p*, a motor driver 15*m*, a counterweight position sensor 15*f*, a load cell 15*d*, a tachometer 15*h*, a voltmeter 15*v*, and an ammeter 15*a*.

Alternatively, an application-specific integrated circuit (ASIC) or field-programmable gate array (FPGA) may be used as the controller in the dynamic control system 15 instead of the PLC 15*p*. Alternatively, the PLC 15*p* and/or the motor driver 15*m* may be combined into one physical control unit.

The foundation 14 may support the pumping unit 1*k* from the surface 3 and the skid 5 and tower base 13 may rest atop the foundation. The PLC 15*p* may be mounted to the skid 5 and/or the tower 11. Lubricant, such as refined and/or synthetic oil 6, may be disposed in the tower base 13 such that the chain 20 is bathed therein as the chain orbits around the chain idler 22 and the drive sprocket 21.

The electric motor 16 may include a stator disposed in a housing mounted to the skid 5 and a rotor disposed in the stator for being torsionally driven thereby. The electric motor 16 may have one or more, such as three, phases. The electric motor 16 may be an induction motor, a switched reluctance motor, or a permanent magnet motor, such as a brushless direct current motor.

The motor driver 15*m* may be mounted to the skid 5 and be in electrical communication with the stator of the electric motor 16 via a power cable. The power cable may include a pair of conductors for each phase of the electric motor 16. The motor driver 15*m* may be variable speed including a rectifier and an inverter. The motor driver 15*m* may receive a three phase alternating current (AC) power signal from a three phase power source, such as a generator or transmission lines. The rectifier may convert the three phase AC power signal to a direct current (DC) power signal and the inverter may modulate the DC power signal to drive each phase of the motor stator based on speed instructions from the PLC 15*p*. The voltmeter 15*v* and ammeter 15*a* may be connected to the motor driver 15*m* or between the motor driver and the three phase power source for measuring electrical power consumed by the motor driver from the three phase power source.

Alternatively, the electric motor 16 may be a hydraulic motor and the electric motor driver may be a hydraulic power unit. Alternatively, the prime mover may be an internal combustion engine fueled by natural gas available at the well site and the motor driver may be a fuel injection system.

The rotary linkage 17 may torsionally connect the rotor of the electric motor 16 to an input shaft of the reducer 18 and may include a sheave connected to the rotor, a sheave connected to the input shaft, and a V-belt connecting the sheaves. The reducer 18 may be a gearbox including the input shaft, an input gear connected to the input shaft, an output gear meshed with the input gear, an output shaft connected to the output gear, and a gear case mounted to the skid 5. The output gear may have an outer diameter substantially greater than an outer diameter of the input gear to achieve reduction of angular speed of the electric motor 16 and amplification of torque thereof. The drive sprocket 21 may be torsionally connected to the output shaft of the reducer 18. The tachometer 15*h* may be mounted on the reducer 18 to monitor an angular speed of the output shaft and may report the angular speed to the PLC 15*p* via a data link.

The chain 20 may be meshed with the drive sprocket 21 and may extend to the idler 22. The idler 22 may include an idler sprocket 22*k* meshed with the chain 20 and an adjustable frame 22*f* mounting the idler sprocket to the tower 11 while allowing for rotation of the idler sprocket relative thereto. The adjustable frame 22*f* may vary a height of the idler sprocket 22*k* relative to the drive sprocket 21 for tensioning the chain 20.

The carriage 19 may longitudinally connect the counterweight assembly 10 to the chain 20 while allowing relative transverse movement of the chain relative to the counterweight assembly. The carriage 19 may include a block base 19*b*, one or more (four shown) wheels 19*w*, a track 19*t*, and a swivel knuckle 19*k*. The track 19*t* may be connected to a bottom of the counterweight assembly 10, such as by fastening. The wheels 19*w* may be engaged with upper and lower rails of the track 19*t*, thereby longitudinally connecting the block base 19*b* to the track while allowing transverse movement therebetween. The swivel knuckle 19*k* may include a follower portion assembled as part of the chain 20 using fasteners to connect the follower portion to adjacent links of the chain. The swivel knuckle 19*k* may have a shaft portion extending from the follower portion and received by a socket of the block base 19*b* and connected thereto by bearings (not shown) such that swivel knuckle may rotate relative to the block base.

The counterweight assembly 10 may be disposed in the tower 11 and longitudinally movable relative thereto. The counterweight assembly 10 may include a box 10*b*, one or more counterweights 10*w* disposed in the box, and guide wheels 10*g*. Guide wheels 10*g* may be connected at each corner of the box 10*b* for engagement with respective guide rails of the tower 11, thereby transversely connecting the box to the tower. The box 10*b* may be loaded with counterweights 10*w* until a total balancing weight of the counterweight assembly 10 corresponds to the weight of the rod string 1*r* and/or the weight of the column of production fluid.

The crown 7 may be a frame mounted atop the tower 11. The drum assembly 8 may include a drum 8*d*, shaft 8*s*, one or more ribs 8*r* connecting the drum to the shaft, one or more pillow blocks 8*p* mounted to the crown 7, and one or more bearings 8*b* for supporting the shaft from the pillow blocks while accommodating rotation of the shaft relative to the pillow blocks.

Figure 2:
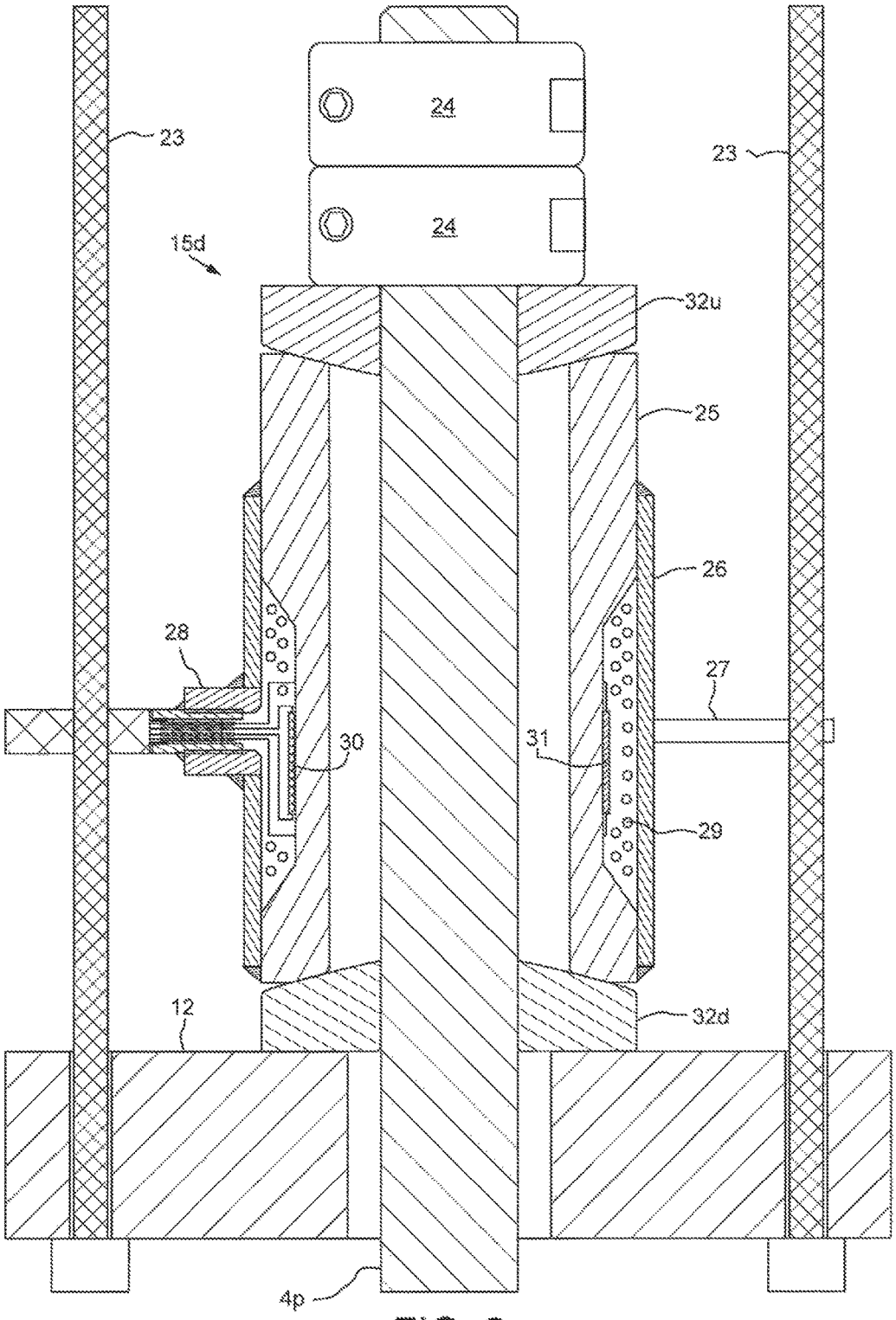
FIG. 2 illustrates a load cell of the dynamic control system.

The load belt 9 may have a first end longitudinally connected to a top of the counterweight box 10*b*, such as by a hinge, and a second end linked to the hanger bar 12, such as by one or more wire ropes 23 (pair shown in FIG. 2). The load belt 9 may extend from the counterweight assembly 10 upward to the drum assembly 8, over an outer surface of the drum, and downward to the polished rod 4*p*.

FIG. 2 illustrates the load cell 15*d*. The polished rod 4*p* may extend through a bore of the hanger bar 12 and a bore of the load cell 15*d* and one or more (pair shown) rod clamps 24 may be fastened to an upper portion of the polished rod 4*p*. The load cell 15*d* may be disposed between a lower one of the rod clamps 24 and an upper face of the hanger bar 12, thereby compressively transmitting load between the polished rod 4*p* and the load belt 9.

The load cell 15*d* may include a tubular body 25, a sleeve 26, an arm 27, and a nipple 28. The arm 27 may be mounted to the sleeve 26 and extend from the sleeve by a distance sufficient to engage one of the wire ropes 23, thereby torsionally arresting the load cell 15*d* therefrom. An outer surface of the body 25 may have an upper shoulder, a lower shoulder, and a reduced diameter waist formed therein and the waist may extend between the shoulders. The sleeve 26 may be disposed around the body 25 and cover the shoulders and waist thereof, thereby forming a sensor chamber between the sleeve and the body. The sleeve 26 may have a port formed through a wall thereof and the nipple 28 may line the port. The sleeve 26 may be mounted to the body 25 and the nipple 28 may be mounted to the sleeve 26, such as by welding, brazing, or soldering, thereby hermetically sealing an inert atmosphere, such as nitrogen 29, within the sensor chamber.

The load cell 15*d* may further include a circuit of one or more longitudinal strain gages 30 mounted to the waist of the body 25, such as by adhesive. The strain gages 30 may each be made from metallic foil, semiconductor, or optical fiber. An electrical socket may be sealingly mounted in the nipple 28 and the strain gages may be in electrical communication with the socket via electric wires. A data link, such as a flexible electric cable, may extend from the socket to the PLC 15*p* to provide data and power communication between the PLC and the load cell 15*d*. The PLC may 15*p* may determine force exerted on the rod string 1*r* by the long-stroke pumping unit 1*k* from the strain measurements reported by the load cell 15*d*. The load cell 15*d* may further include an accelerometer 31 mounted to the waist of the body 25, such as by adhesive. The accelerometer 31 may be in electrical communication with the socket via electric wires.

Alternatively, the load cell 15*d* may include an onboard electrical power source, such as a battery, and an onboard wireless data link, such as a radio frequency transmitter or transceiver for communication with the PLC 15*p*.

The load cell 15*d* may further include an upper washer 32*u* and a lower washer 32*d*. The body 25 may have profiled, such as spherical or conical, upper and lower faces and each adjacent face of the washers 32*u,b* may have a mating profile. An annular clearance may be formed between an inner surface of the body and an outer surface of the polished rod 4*p*. An inner surface of the washers 32*u,d* may be fit to an outer surface of the polished rod 4*p*. The profiled faces may accommodate a non-level hanger bar 12 and compensate for non-level rod clamps 24 by forcing the washers 32*u,b* into alignment with the body 25, thereby also bringing the polished rod 4*p* into alignment with the body.

Figure 3A:
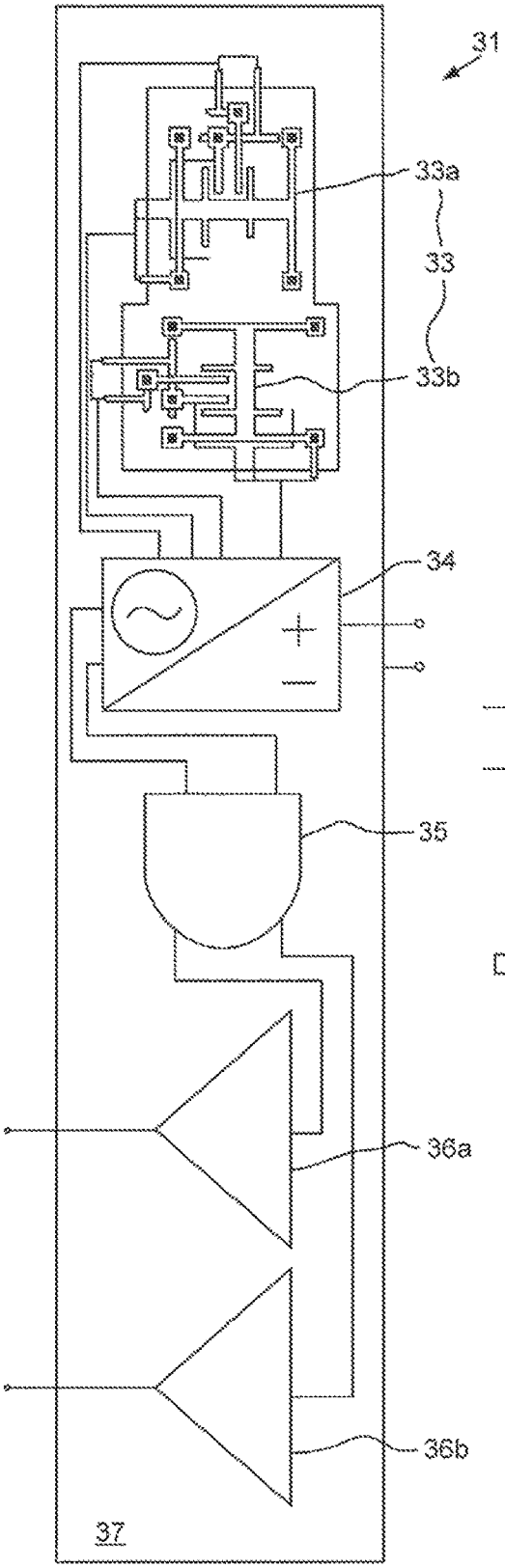
FIGS. 3A and 3B illustrate an accelerometer of the load cell.
Figure 3B:
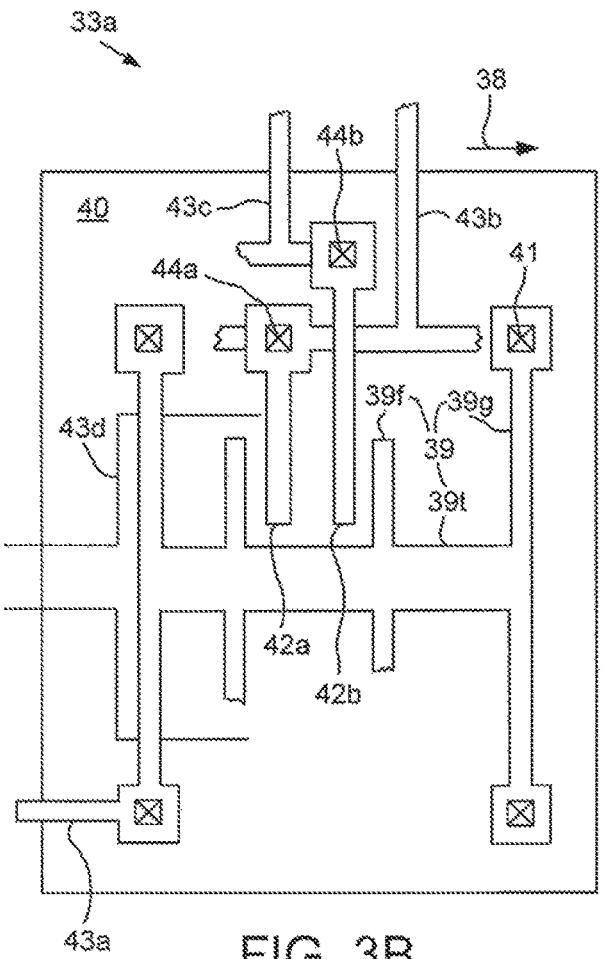

FIGS. 3A and 3B illustrate the accelerometer 31. The accelerometer 31 may be a one or more axes, such as dual-axis, microelectromechanical system (MEMS). The accelerometer 31 may include a sensor 33, a power converter 34, a demodulator 35, and an amplifier 36*a,b* for each axis. The accelerometer 31 may integrated onto a printed circuit board 37. The sensor 33 may include a differential capacitor for each axis, such as a transverse differential capacitor 33*a* and a longitudinal differential capacitor 33*b*. The transverse differential capacitor 33*a* may be oriented to have a sensitive axis 38 aligned with a transverse axis of the body 25 and the longitudinal differential capacitor 33*b* may be oriented to have a sensitive axis (not shown) aligned with a longitudinal axis of the body.

Alternatively, the accelerometer may be a tri-axis MEMS including an additional differential capacitor oriented to have a sensitive axis aligned with a second transverse axis of the body 25 and a corresponding additional amplifier.

The differential capacitors 33*a,b* may be similar or identical and share a common substrate 40. The transverse differential capacitor 33*a* may include a polysilicon beam 39 suspended over the common substrate 40. The beam 39 may rest above a surface of the common substrate 40, on one or more (four shown) posts 41. The beam 39 may be H-shaped and have a pair of legs 39*g* and a trunk 39*t* extending between the legs. The trunk may be stiffer and more massive than the legs 39*g*. The beam 39 may further have a pair of parallel fingers 39*f* extending from the trunk 39*t*. The fingers 39*f* may form one electrode of a parallel plate capacitor and the differential capacitor 33*a* may have a pair of fingers 42*a,b* forming the other electrode. The fingers 42*a,b* may be anchored to the substrate 40 by respective posts 44*a,b*.

Electrical connection may be made to the beam fingers 39*f* via a heavily doped region 43*a*. Electrical connection may be made to the anchored finger 42*a* via a heavily doped region 43*b* and electrical connection to the anchored finger 42*b* may be made via a similar region 43*c*. A doped region 43*d* may be provided beneath the beam 39 and anchored fingers 42*a,b* as a bootstrap diffusion for reducing parasitic capacitance from the beam 39 to the substrate 40.

The doped regions 43*b,c* may be electrically connected to respective channels of an oscillator of the power converter 34. An input of the power converter may be electrically connected to the PLC 15*p* for receiving a direct current power signal therefrom. The power converter 34 may supply sinusoidal or square driving signals to the anchored fingers 42*a,b*. The driving signals may be out of phase, such as by one hundred eighty degrees. The doped region 43*a* may be electrically connected to an input of a buffer amplifier of the power converter 34. The output of the buffer amplifier may be electrically connected to the doped region 43*d*. The output of the buffer amplifier may also be electrically connected to an input of the demodulator 35. An output of the demodulator may be electrically connected to an input of the amplifier 36*a*. An output of the amplifier 36*a* may be electrically connected to the PLC 15*p*.

In operation, when the body 25 and the substrate 40 are accelerated along the transverse sensitive axis 38, the substrate and anchored fingers 42*a,b* move in that direction while the beam trunk 39*t* acts as an inertial mass tending to remain in place. Motion of the beam trunk 39*t* relative to the substrate 40 may be permitted by elasticity of the legs 39*g* which may act as springs. When acceleration is positive, the separation between the anchored finger 42*a* and the adjacent beam finger 39*f* increases, thereby decreasing the capacitance therebetween; conversely, the separation between the anchored finger 42*b* the adjacent beam finger decreases, thereby increasing the capacitance therebetween. The modulator 35 may determine the acceleration from the amplitude of the output sinusoidal or square signal and the direction of the acceleration from the phase of the output signal and supply an analog voltage signal to the PLC 15*p* (amplified by the amplifier 36*a*) proportional to the acceleration and having a polarity indicative of the direction.

Alternatively, the accelerometer 31 may further include a microcontroller for processing the output signal from the accelerometer and supplying the acceleration and direction digitally to the PLC 15*p*. Alternatively, the accelerometer 31 may be modified to operate in a closed-loop fashion instead of an open-loop fashion.

Figure 4A:
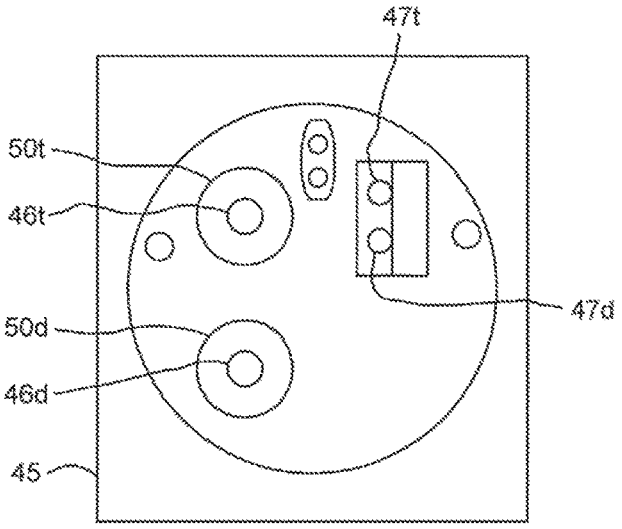
FIGS. 4A and 4B illustrate a counterweight position sensor of the dynamic control system.
Figure 4B:
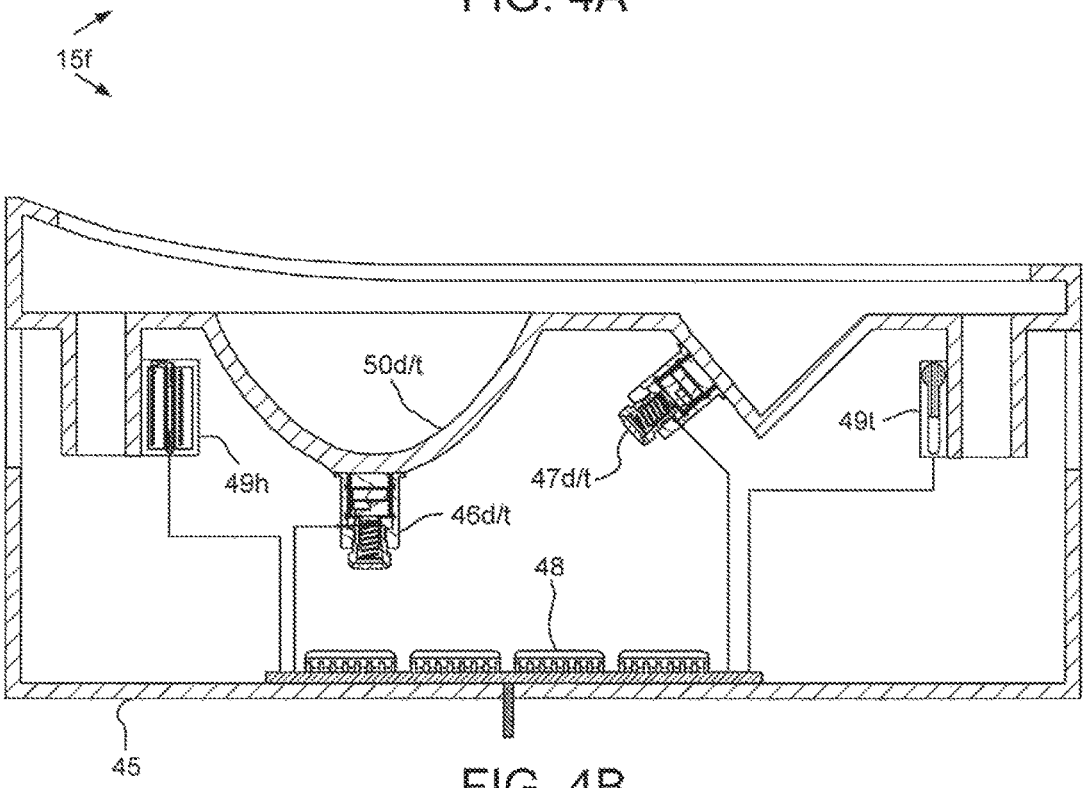

FIGS. 4A and 4B illustrate the counterweight position sensor 15*f*. The counterweight position sensor 15*f* may be contactless, such as an ultrasonic rangefinder. The ultrasonic rangefinder 15*f* may be mounted in the tower base 13 and may be aimed at the counterweight assembly 10. The ultrasonic rangefinder 15*t* may be in power and data communication with the PLC 15*p* via an electric cable. The PLC 15*p* may relay the position measurement of the counterweight assembly 10 to the motor driver 15*m* via a data link. The PLC 15*p* may also utilize measurements from the counterweight position sensor 15*f* to determine velocity and/or acceleration of the counterweight assembly 10.

The ultrasonic rangefinder may include a housing 45, one or more ultrasonic transducers, such as a long range transmitter 46*t*, a long range detector 46*d*, a short range transmitter 47*t*, a short range detector 47*d*, an electronics package 48, and one or more atmospheric sensors, such as a thermometer 49*t*, and a hygrometer 49*h*. The long range transmitter 46*t* and detector 46*d* may each be mounted to respective cones 50*t,d* to improve the efficiency thereof. The long range transducers 46*t,d* and cones 50*t,d* may be disposed in and mounted to a front panel of the housing 45 aimed directly at a bottom of the counterweight assembly 10. The short range transducers 47*d,t* may be disposed in and mounted to the front panel and aimed at guide rails of the tower 11. The atmospheric sensors 49*h,t* may be mounted in the housing 45 adjacent to air circulation openings formed therethrough. The electronics package 48 may be disposed in and mounted to a back panel of the housing 45.

The electronics package 48 may include a control circuit, a driver circuit, a receiver circuit, and an atmospheric circuit integrated on a printed circuit board. The control circuit may include a microcontroller, a memory unit, a clock, a voltmeter, and an analog-digital converter. The driver circuit may include a power converter, such as a pulse generator, for converting a DC power signal supplied by the PLC 15*p* into suitable power signals, such as pulses, for driving the ultrasonic transmitters 46*t*, 47*t*. The driver circuit may operate the ultrasonic transmitters 46*t*, 47*t* at respective suitable frequencies, such as the long range transmitter at a lower frequency and the short range transmitter at a higher frequency. The frequencies may be in the kilo-Hertz (kHz) range, such as twenty-five kHz and forty kHz, respectively. The receiver circuit may include an amplifier and a filter for refining the raw electrical signals from the ultrasonic detectors 46*d*, 47*d*. The atmospheric circuit may include an amplifier and filter for refining the raw electrical signals from the thermometer 49*t* and hygrometer 49*h* and may calculate an adjustment signal for the driver circuit and/or receiver circuit to account for atmospheric conditions.

Each transducer 46*d,t*, 47*d,t* may include a respective: bell, knob, cap, retainer, biasing member, such as a compression spring, linkage, such as a spring housing, and a probe. Each bell may have a respective flange formed in an inner end thereof for mounting to the housing 45/cones 50*d,t*, such as by one or more respective fasteners. Each bell may have a cavity formed in an inner portion thereof for receiving the respective probe and a smaller bore formed in an outer portion thereof for receiving the respective knob.

Each knob may be linked to the respective bell, such as by mating lead screws formed in opposing surfaces thereof. Each knob may be tubular and may receive the respective spring housing in a bore thereof. Each knob may have a first thread formed in an inner surface thereof adjacent to an outer end thereof for receiving the respective cap. Each knob may also have a second thread formed in an inner surface thereof adjacent to the respective first thread for receiving the respective retainer.

Each spring housing may be tubular and have a bore for receiving the respective spring and a closed inner end for trapping an inner end of the spring therein. An outer end of each spring may bear against the respective retainer, thereby biasing the respective probe into engagement with the housing 45/cones 50*d,t*. A compression force exerted by the spring against the respective probe may be adjusted by rotation of the knob relative to the respective bell. Each knob may also have a stop shoulder formed in an inner surface and at a mid portion thereof for engagement with a stop shoulder formed in an outer surface of the respective spring housing.

Each probe may include a respective: shell, jacket, backing, vibratory element, and protector. Each shell may be tubular and have a substantially closed outer end for receiving a coupling of the respective spring housing and a bore for receiving the respective backing, vibratory element, and protector. Each bell may carry one or more seals in an inner surface thereof for sealing an interface formed between the bell and the respective shell. Each seal may be made from an elastomer or elastomeric copolymer and may additionally serve to acoustically isolate the respective probe from the respective bell. Each bell and each shell may be made from a metal or alloy, such as steel or stainless steel. Each backing may be made from an acoustically absorbent material, such as an elastomer, elastomeric copolymer, or acoustic foam. The elastomer or elastomeric copolymer may be solid or have voids formed throughout.

Each vibratory element may be a disk made from a piezoelectric material. A peripheral electrode may be deposited on an inner face and side of each vibratory element and may overlap a portion of an outer face thereof. A central electrode may be deposited on the outer face of each vibratory element. A gap may be formed between the respective electrodes and each backing may extend into the respective gap for electrical isolation thereof. Electrical wires may be connected to the respective electrodes and combine into a cable for extension to an electrical coupling connected to the bell. Each pair of wires or each cable may extend through respective conduits formed through the backing and the shell. Each backing may be bonded or molded to the respective vibratory element and electrodes.

The protector may be bonded or molded to the respective peripheral electrode. Each jacket may be made from an injectable polymer and may bond the respective backing, peripheral electrode, and protector to the respective shell while electrically isolating the peripheral electrode therefrom. Each protector may be made from an engineering polymer and also serve to electrically isolate the respective peripheral electrode from the mandrel.

Figure 5:
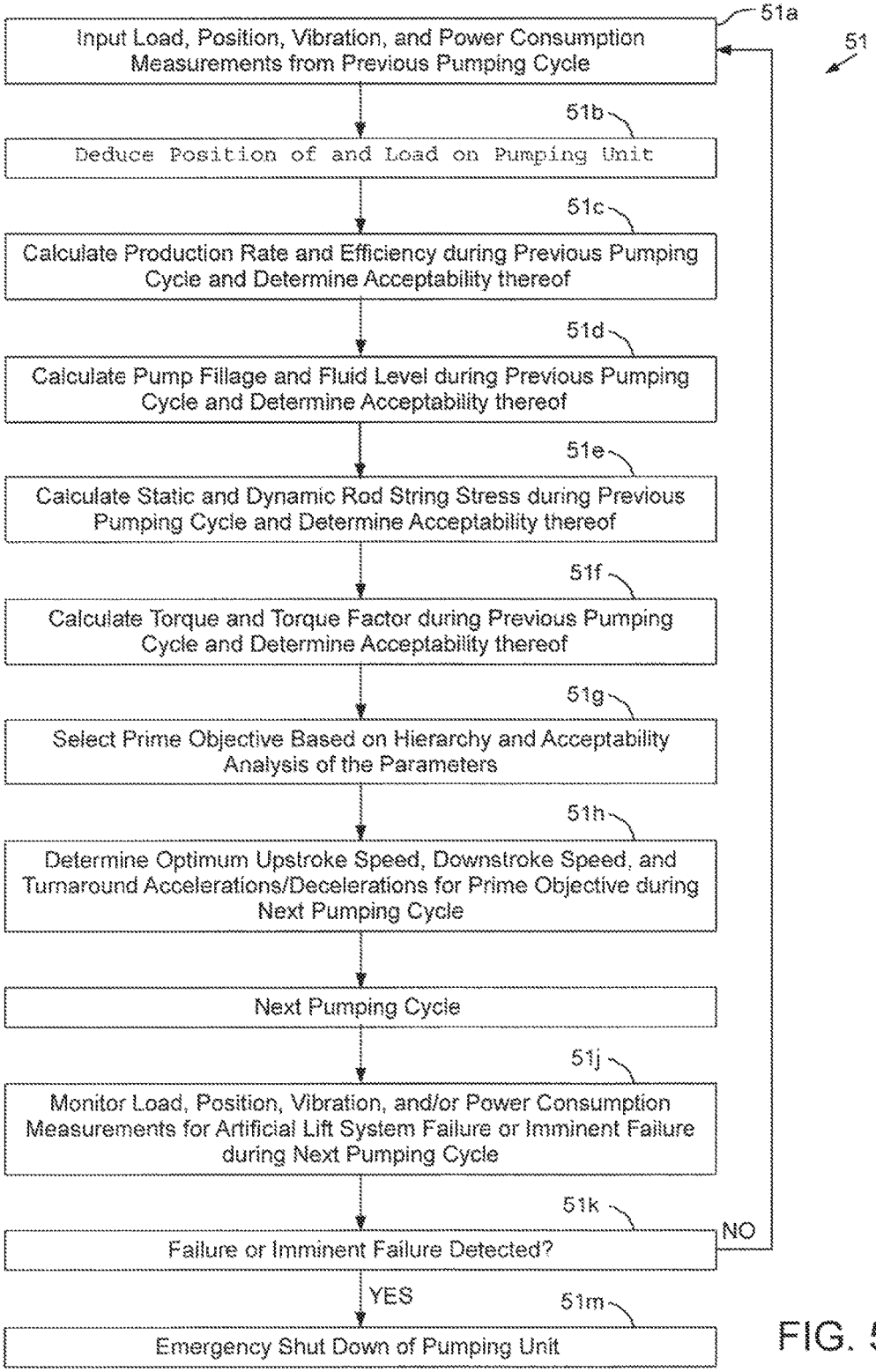
FIG. 5 illustrates logic of the dynamic control system.

FIG. 5 illustrates logic of the dynamic control system 15. In operation, the electric motor 16 is activated by the PLC 15*p* and operated by the motor driver 15*m* to torsionally drive the drive sprocket 21 via the linkage 17 and reducer 18. Rotation of the drive sprocket 21 drives the chain 20 in an orbital loop around the drive sprocket and the idler sprocket 22*k*. The swivel knuckle 19*k* follows the chain 20 and resulting movement of the block base 19*b* along the track 19*t* translates the orbital motion of the chain into a longitudinal driving force for the counterweight assembly 10, thereby reciprocating the counterweight assembly along the tower 11. Reciprocation of the counterweight assembly 10 counter-reciprocates the rod string 1*r* via the load belt 9 connection to both members.

During operation of the long-stroke pumping unit 1*k*, the PLC 15*p* may control operation of the electric motor 16 by being programmed to perform an operation 51. The operation 51 may include a first act 51*a* of inputting load and vibration measurements (from load cell 15*d* ) power consumption measurements (from voltmeter 15*v* and ammeter 15*a* ) and position measurements (from counterweight position sensor 15*f*') for a previous pumping cycle. The PLC 15*p* may input the measurements continuously or intermittently during or after the previous pumping cycle.

The PLC 15*p* may use the inputted measurements to perform a second act 51*b* of deducing position of and load on the downhole pump during the previous pumping cycle. In one example, the position and load may be deduced by using the inputted measurements to solve a wave equation. The wave equation may be a second order partial differential equation with two independent variables (distance and time) that models the elastic behavior of the rod string 1*r*. The wave equation may be numerically solved by enforcing boundary conditions at the surface 3. By solving the wave equation, the position of and load on the downhole pump during the previous pumping cycle may be deduced.

In a third act 51*d*, the PLC 15*p* may calculate a production rate and produced volume during the previous pumping cycle. In one example, the production rate and the produced volume may be calculated using the wave equation solution. The PLC 15*p* may utilize the known depth of the downhole pump, known density of the production fluid, and known frictional loss of flow through the production tubing to calculate pumping power obtained. The pumping power obtained may be divided by the measured power consumed to obtain the efficiency during the previous pumping cycle. The PLC 15*p* may then determine the acceptability of the calculated production rate and efficiency by comparison of each to a preset minimum value, maximum value, or range between the minimum and maximum values. The PLC 15*p* may also calculate a deviation from the minimum value, maximum value and/or average of the values.

In a fourth act 51*d*, the PLC 15*p* may calculate pump fillage and fluid level during the previous pumping cycle. In one example, the pump fillage and fluid level may be calculated using the wave equation solution. The PLC 15*p* may then determine the acceptability of the calculated pump fillage and fluid level by comparison of each to a preset minimum value, maximum value, or range between the minimum and maximum values. The PLC 15*p* may also calculate a deviation from the minimum value, maximum value and/or average of the values.

In a fifth act 51*e*, the PLC 15*p* may calculate static and dynamic stress in the rod string 1*r* during the previous pumping cycle. In one example, the static and dynamic stress may be calculated from the wave equation solution and the measured load and vibration measurements. The PLC 15*p* may then determine the acceptability of the static and dynamic rod stress by comparison of each to a preset minimum value, maximum value, or range between the minimum and maximum values. The PLC 15*p* may also calculate a deviation from the minimum value, maximum value and/or average of the values.

The PLC 15*p* may use the power consumption measurements to perform a sixth act 51*f* of calculating a torque and torque factor of the electric motor 16 during the previous pumping cycle. The PLC 15*p* may then determine the acceptability of the torque and torque factor by comparison of each to a preset minimum value, maximum value, or range between the minimum and maximum values. The PLC 15*p* may also calculate a deviation from the minimum value, maximum value and/or average of the values.

Alternatively, the PLC 15*p* may use the measured load and vibration measurements and the wave equation solution to calculate and determine the acceptability of other parameters, such as fluid velocity in the production tubing 2*p* to maintain carrying of particulates in the production fluid, excess drag of the production fluid on the rod string 1*r* interfering with movement thereof, and gas-oil ratio of the production fluid. Alternatively, the vibration measurements may be a control parameter and the acceptability thereof determined.

The PLC 15*p* may use the acceptability analysis of the calculated parameters to perform a seventh act 51*g* of selecting a prime objective for the next pumping cycle from the calculated parameters. The PLC 15*p* may be in data communication with a home office (not shown) via long distance telemetry (not shown). If any of the calculated parameters are found to be unacceptable, then the PLC 15*p* may alert the home office.

The PLC 15*p* may select the prime objective based on a preset hierarchy of the calculated parameters and the deviations thereof. The hierarchy may be used to apply weighting factors to the deviations to obtain a score for each of the calculated parameters and the scores used to select the prime objective. The hierarchy may be user-specified or the PLC 15*p* may determine the hierarchy based upon initial well characteristics, such as the depth of the pump, production fluid characteristics, and/or deviation of the wellbore. Simply because one or more of the calculated parameters are deemed unacceptable does not mean that the parameter will automatically be selected as the prime objective as a low order in the hierarchy may offset the relatively high deviation.

Alternatively, a reciprocation speed of the rod string 1*r*, such as strokes per minute, may be considered by the PLC 15*p* as a control parameter and the acceptability thereof determined instead of or in addition to production rate. Alternatively, the prime objective may be a compromise between the top two (or more) scores. Alternatively, the PLC 15*p* may have a first hierarchy for acceptable parameters and a second hierarchy for unacceptable parameters. Alternatively, the PLC 15*p* may include a machine learning algorithm for adjusting the hierarchy based on previous pumping cycles.

The PLC 15*p* may use the selected prime objective to perform an eighth act 51*h* of determining an optimum upstroke speed, downstroke speed, and turnaround accelerations and decelerations for a next pumping cycle. The PLC 15*p* may then instruct the motor driver 15*m* to operate the electric motor 16 at the optimum speeds, accelerations, and decelerations during the next pumping cycle.

During the next pumping cycle, the PLC 15*p* may perform a ninth act 51*j* of monitoring any or all of: the load, position, vibration, and power consumption measurements for detecting failure or imminent failure of the artificial lift system 1. For example, excessive vibration of the rod string 1*r* as measured by the load cell 15*d* may indicate imminent failure of the rod string or the onset of a pumped off condition. Direct measurement of vibration using the accelerometer 31 may be more accurate and expeditious than trying to infer vibration from by calculating derivatives of the position and time data.

At a tenth act 51*k*, should the PLC 15*p* detect failure or imminent failure of the artificial lift system 1, the PLC may perform an emergency shut down of the pumping unit 1*k*. The emergency shut down may include the PLC 15*p* instructing the motor driver 15*m* to operate the electric motor 16 to control the descent of the counterweight assembly 10 until the counterweight assembly reaches the tower base 13. The PLC 15*p* may then shut down the electric motor 16. The PLC 15*p* may report the emergency shut down to the home office so that a technician and/or workover rig (not shown) may be dispatched to the well site to repair the artificial lift system 1.

Alternatively, the pumping unit 1*k* may include a braking system as a contingency for failure of the rod string 1*r* and/or failure of the load belt 9 and the PLC 15*p* may operate the braking system in response to detection thereof. Alternatively, if only imminent failure is detected, then the PLC 15*p* may include an emergency hierarchy and/or set of emergency acceptability values for conservative operation of the pumping unit 1*k*.

Figure 6:
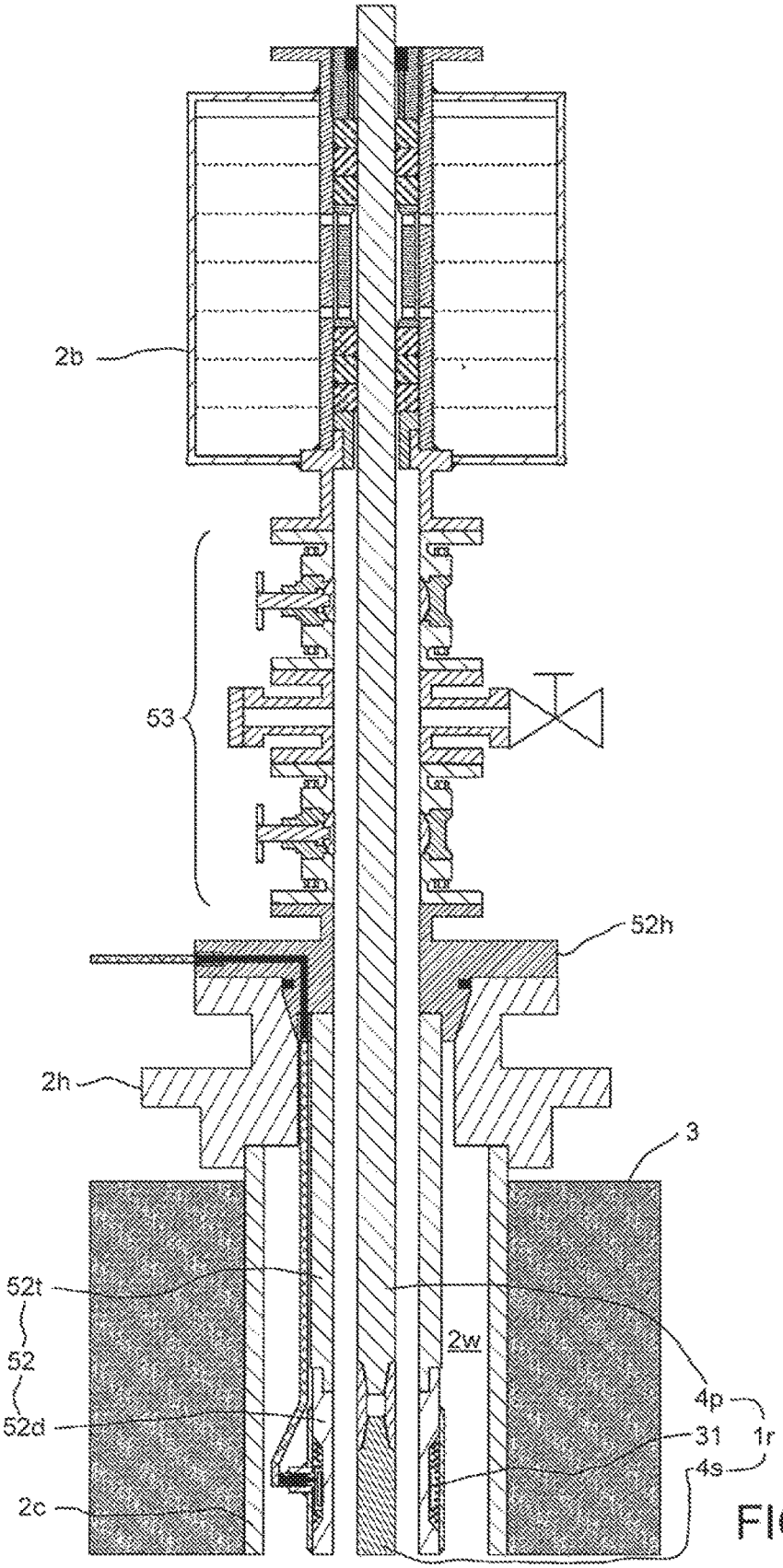
FIG. 6 illustrates an alternative dynamic control system, according to another embodiment of the present disclosure.

FIG. 6 illustrates an alternative dynamic control system, according to another embodiment of the present disclosure. The alternative dynamic control system may be similar to the dynamic control system 15 except that the accelerometer 31 may be located along a modified production string 52 instead of being part of the load cell 15*d*. The modified production string 52 may include a string of production tubing 52*t*, the downhole pump connected to a bottom of the production tubing, a load cell 52*d* interconnected with the production tubing, such as by threaded couplings, and a hanger 52*h* mounting the production tubing to the wellhead 2*h*. The load cell 52*d* may be similar to the load cell 15*d*. An electric cable may extend from the load cell 52*d* to a lower connector of the hanger 52*h*. The hanger 52*h* may have an electric coupling disposed in a passage formed therethrough for providing communication between the lower connector and an upper connector. A flexible electric cable may extend from the upper connector to the PLC 15*p* for providing data and power communication between the PLC and the load cell 52*d*. The accelerometer 31 being in the load cell 52*d* may measure vibration of the production string 52 instead of the rod string 1*r*. The load cell 52*d* may also include the strain gages 30 for measuring longitudinal load exerted on the production string 52.

In another embodiment, the alternative dynamic control system may include an accelerometer 31 in both load cells 15*d*, 52*d*. Alternatively, the strain gages 30 may be omitted from the load cell 52*d*. Alternatively, the load cell 52*d* or the accelerometer 31 may be mounted on the wellhead 2*h*, the tubing hanger 52*h*, or the production tree 53.

Figure 7A:
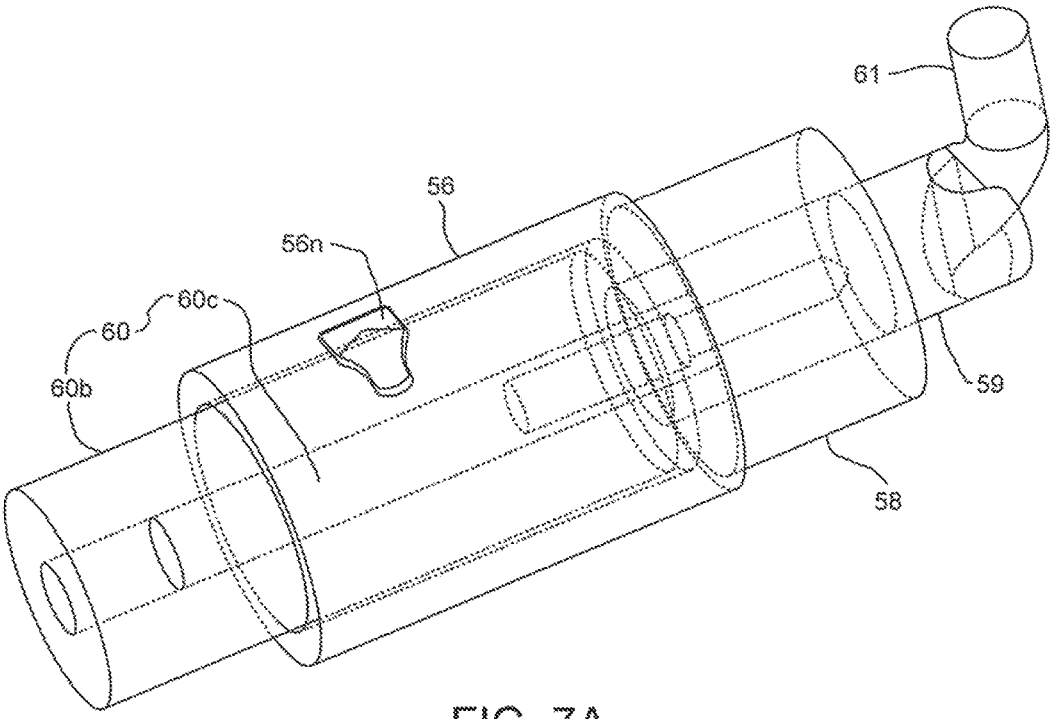
FIGS. 7A-7C illustrate an alternative counterweight position sensor for use with the dynamic control system, according to another embodiment of the present disclosure.
Figure 7B:
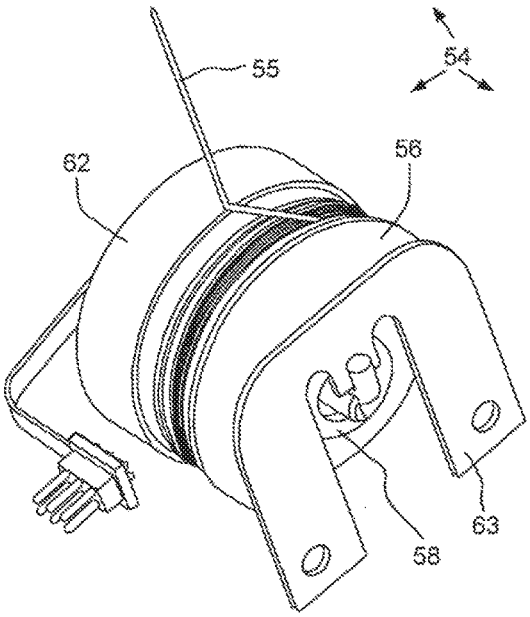
Figure 7C:
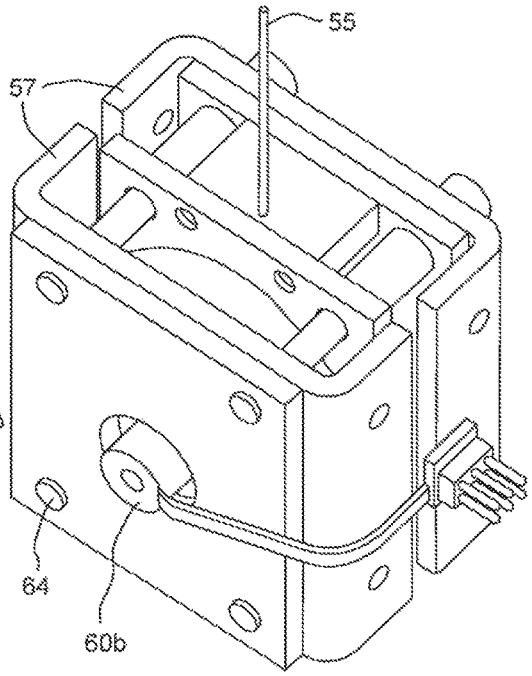

FIGS. 7A-7C illustrate an alternative counterweight position sensor 54 for use with the dynamic control system 15, according to another embodiment of the present disclosure. The alternative counterweight position sensor 54 may be used with the dynamic control system 15 instead of the counterweight position sensor 15*f*. The alternative counterweight position sensor 54 may be mounted in the tower base 13 or to the crown 7. The alternative counterweight position sensor 54 may include a string 55 connected to a top or bottom of the counterweight assembly 10 and wound onto a tubular spool 56 that rotates as the string is unwound and wound as determined by the position of the counterweight assembly. The string 55 may be a single strand or braided rope of a high strength material, such as spring steel, carbon, or aramid.

The spool 56 may be disposed in a frame 57 and supported for rotation relative thereto by one or more bushings 58. The spool 56 may have a thread formed along an inner surface thereof for interaction with a screw shaft 59. The threads may directly engage to form a lead screw, balls (not shown) may be disposed therebetween to form a ball screw, or planetary threaded rollers may be disposed therebetween to form a roller screw. The screw shaft 59 may be mounted to a core 60*c* of a linear variable differential transformer (LVDT) 60. A torsional restraint, such as a tab 61, may be mounted to the screw shaft 59 and received by a guide (not shown) of the frame 57 such that the screw shaft and LVDT core 60*c* are torsionally connected to the frame while being free to move linearly relative to the frame. A tubular body 60*b* of the LVDT 60 may be mounted to the frame 57.

An electric cable may extend between the LVDT body 60*b* and the PLC 15*p* for providing power and data communication therebetween. The LVDT core 60*c* may be ferromagnetic and the LVDT body 60*b* may have a central primary coil (not shown) and a pair of secondary coils (not shown) straddling the primary coil. The LVDT core 60*c* may be located adjacent to the LVDT body 60*b*, such as by being at least partially received in a bore thereof. The primary coil may be driven by an AC signal and the secondary coils monitored for response signals which may vary in response to position of the core 60*c* relative to the body 60*b*.

The alternative counterweight position sensor 54 may further include a recoil spring 62 having a first end connected to the spool 56 at notch 56*n* and a second end connected to the frame 57. The recoil spring 62 may bias the spool 56 toward a wound position. The alternative counterweight position sensor 54 may further a backlash spring 63 to prevent backlash between the threads of the spool 56 and the screw shaft 59. The frame 57 may be made of U-shaped stamped plates directed toward each other to form an internal area therebetween. The frame 57 may further include rectangular stamped plates fastened to the U-shaped plates by threaded fasteners 64.

Alternatively, the dynamic control system 15 may be used with other sucker rod pumping units besides the long-stroke pumping unit 1*k*, such as a pump-jack. Alternatively, the dynamic control system 15 may be used with other long-stroke pumping units, such as a hydraulic pump-jack. Alternatively, the dynamic control system 15 may be used with other long-stroke pumping units, such as a unit having a linear electric motor including a stator mounted to the tower 11 and a traveler mounted to the counterweight box 10*b*. Alternatively, the dynamic control system may be used with a linear electric motor including a stator mounted to the wellhead 2*h* and a traveler integrated with the polished rod 4*p*. In this alternative, the dynamic control system may have a rod string position sensor instead of a counterweight position sensor and the rod string position sensor may be either of the counterweight position sensors 15*d*, 54.

Alternatively, the dynamic control system 15 may further include a power converter and a battery. The power converter may include a rectifier, a transformer, and an inverter for converting electric power generated by the electric motor 16 on the downstroke to usable power for storage by the battery. The battery may then return the stored power to the motor driver 15*m* on the upstroke, thereby lessening the demand on the three phase power source.

Figure 8A:
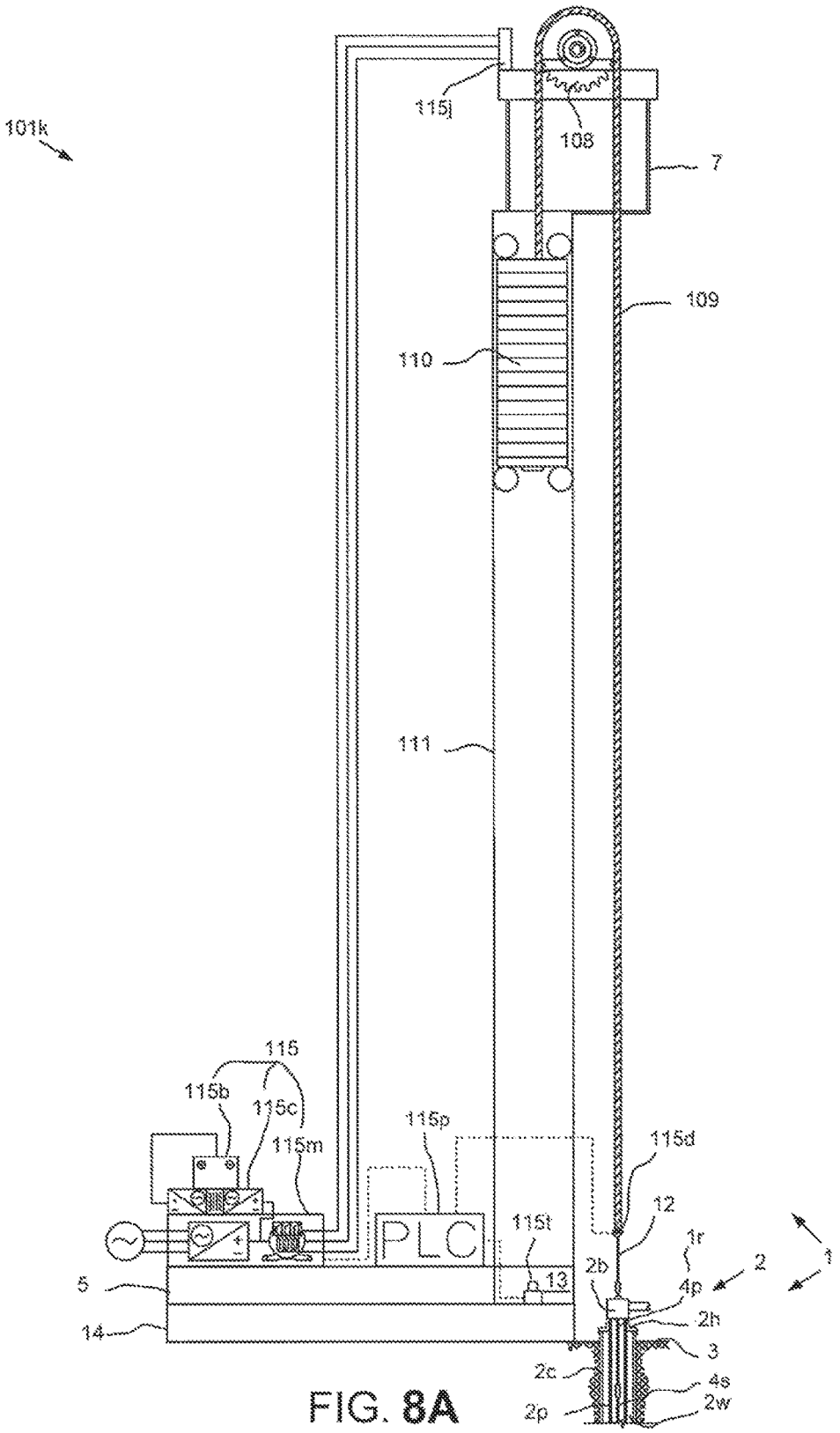
FIGS. 8A and 8B illustrate a long-stroke pumping unit, according to one embodiment of the present disclosure.
Figure 8B:
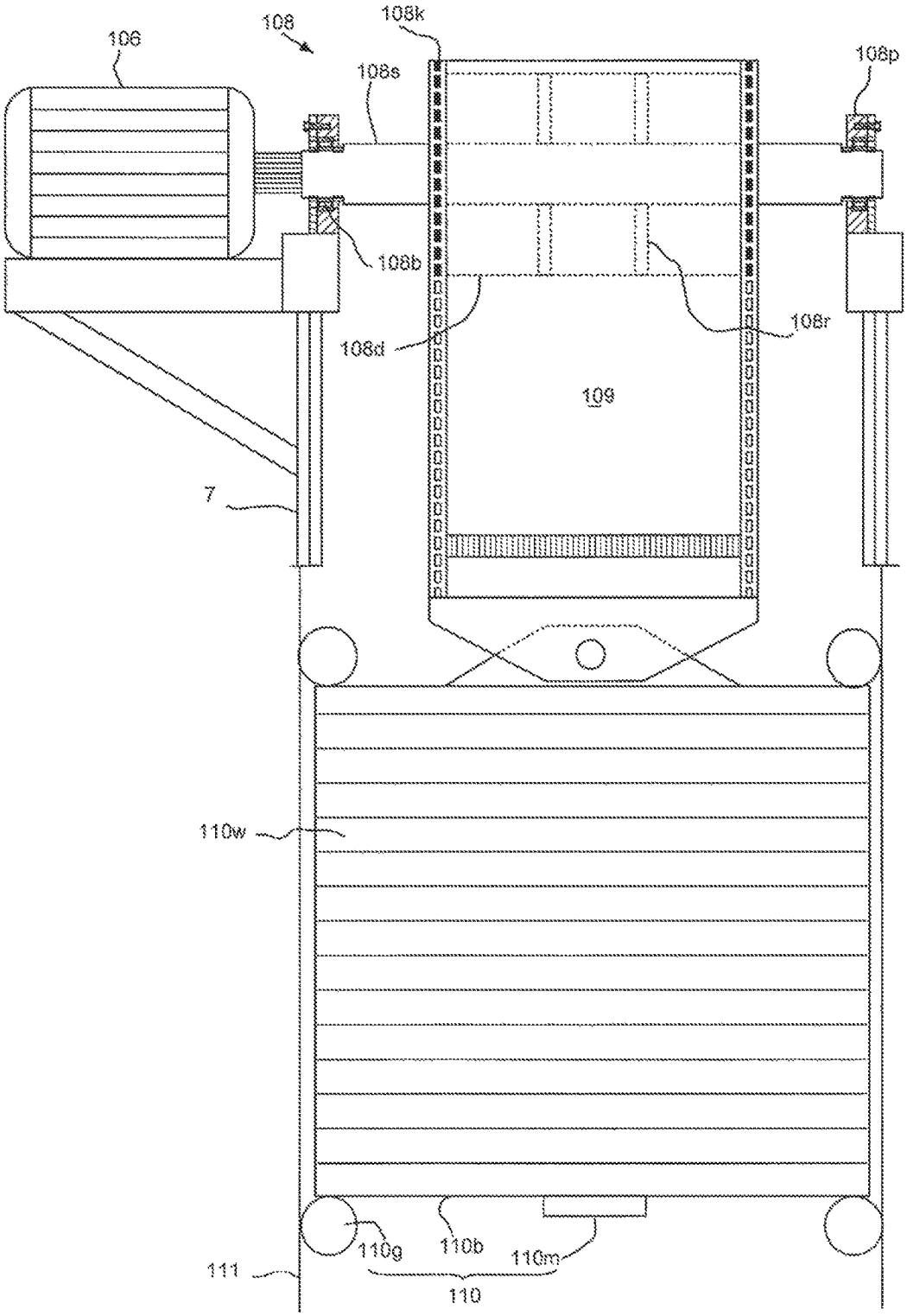

FIGS. 8A and 8B illustrate a long-stroke pumping unit 101 k, according to another embodiment of the present disclosure. The long-stroke pumping unit 101*k* may be part of an artificial lift system 1 further including a rod string 1*r* and a downhole pump (not shown). The artificial lift system 1 may be operable to pump production fluid (not shown) from a hydrocarbon bearing formation (not shown) intersected by a well 2. The well 2 may include a wellhead 2*h* located adjacent to a surface 3 of the earth and a wellbore 2*w* extending from the wellhead. The wellbore 2*w* may extend from the surface 3 through a non-productive formation and through the hydrocarbon-bearing formation (aka reservoir).

A casing string 2*c* may extend from the wellhead 2*h* into the wellbore 2*w* and be sealed therein with cement (not shown). A production string 2*p* may extend from the wellhead 2*h* and into the wellbore 2*w*. The production string 2*p* may include a string of production tubing and the downhole pump connected to a bottom of the production tubing. The production tubing may be hung from the wellhead 2*h*.

The downhole pump may include a tubular barrel with a standing valve located at the bottom that allows production fluid to enter from the wellbore 2*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 1*r* for reciprocation thereby. During the upstroke of the plunger, the traveling valve may be closed and any fluid above the plunger in the production tubing may be lifted towards the surface 3. Meanwhile, the standing valve may open and allow fluid to enter the pump barrel from the wellbore 2*w*. During the downstroke of the plunger, the traveling valve may be open and the standing valve may be closed to transfer the fluid from the pump barrel to the plunger.

The rod string 1*r* may extend from the long-stroke pumping unit 101*k*, through the wellhead 2*h*, and into the wellbore 2*w*. The rod string 1*r* may include a jointed or continuous sucker rod string 4*s* and a polished rod 4*p*. The polished rod 4*p* may be connected to an upper end of the sucker rod string 4*s* and the pump plunger may be connected to a lower end of the sucker rod string, such as by threaded couplings.

A production tree (not shown) may be connected to an upper end of the wellhead 2*h* and a stuffing box 2*b* may be connected to an upper end of the production tree, such as by flanged connections. The polished rod 4*p* may extend through the stuffing box 2*b*. The stuffing box 2*b* may have a seal assembly (not shown) for sealing against an outer surface of the polished rod 4*p* while accommodating reciprocation of the rod string 1*r* relative to the stuffing box.

The long-stroke pumping unit 101*k* may include a skid 5, a motor 106, one or more ladders and platforms (not shown), a standing strut (not shown), a crown 7, a belt driver 108, a load belt 109, one or more wind guards (not shown), a counterweight assembly 110, a tower 111, a hanger bar 12, a tower base 13, a foundation 14, and a control system 115. The control system 115 may include a programmable logic controller (PLC) 115*p*, a motor driver 115*m*, a counterweight position sensor, such as a laser rangefinder 115*t*, a load cell 115*d*, a power converter 115*c*, a battery 115*b*, and a motor junction 115*j*. The foundation 14 may support the pumping unit 101*k* from the surface 3 and the skid 5 and tower base 13 may rest atop the foundation. The PLC 115*p* may be mounted to the skid 5 and/or the tower 111.

Alternatively, an application-specific integrated circuit (ASIC) or field-programmable gate array (FPGA) may be used as the controller in the control system 115 instead of the PLC 115*p*.

The counterweight assembly 110 may be disposed in the tower 111 and longitudinally movable relative thereto. The counterweight assembly 110 may include a box 110*b*, one or more counterweights 110*w* disposed in the box 110*b*, and guide wheels 110*g*. Guide wheels 110*g* may be connected at each corner of the box 110*b* for engagement with respective guide rails of the tower 111, thereby transversely connecting the box 110*b* to the tower 111. The box 110*b* may be loaded with counterweights 110*w* until a total balancing weight of the counterweight assembly 110 corresponds to the weight of the rod string 1*r* and/or the weight of the column of production fluid. The counterweight assembly 110 may further include a mirror 110*m* mounted to a bottom of the box 110*b* and in a line of sight of the laser rangefinder 115*t*.

The crown 7 may be a frame mounted atop the tower 111. The belt driver 108 may include a shaft 108*s*, a drum 108*d*, one or more (pair shown) sprockets 108*k*, one or more ribs 108*r*, one or more (pair shown) pillow blocks 108*p* mounted to the crown 7, and one or more (pair shown) bearings 108*b* for supporting the shaft 108*s* from the pillow blocks 108*p* while accommodating rotation of the shaft 108*s* relative to the pillow blocks 108*p*. The ribs 108*r* may mount the drum 108*d* to the drive shaft 108*s*. The sprockets 108*k* may be disposed along the drive shaft 108*s* in a straddling relationship to the drum 108*d* and may be mounted to the drive shaft 108*s*. The motor 106 may be an electric motor and have one or more, such as three, phases. The motor 106 may be an induction motor, a switched reluctance motor, or a permanent magnet motor, such as a brushless direct current motor. The motor 106 may include a stator mounted to the crown 7 and a rotor disposed in the stator for being torsionally driven thereby. The drive shaft 108*s* may be torsionally connected to the rotor of the motor 106 by mating profiles, such as splines, formed at adjacent ends of the rotor and drive shaft 108*s*.

The load belt 109 may have a first end longitudinally connected to a top of the counterweight box 110*b*, such as by a hinge, and a second end longitudinally connected to the hanger bar 12, such as by wire rope. The load belt 109 may extend from the counterweight assembly 110 upward to the belt driver 108, over outer surfaces of the drum 108*d* and sprockets 108*k*, and downward to the hanger bar 12. The hanger bar 12 may be connected to the polished rod 4*p*, such as by a rod clamp, and the load cell 115*d* may be disposed between the rod clamp and the hanger bar 12. The load cell 115*d* may measure tension in the rod string 1*r* and report the measurement to the PLC 115*p* via a data link.

The laser rangefinder 115*t* may be mounted in the tower base 13 and aimed at the mirror 110*m*. The laser rangefinder 115*t* may be in power and data communication with the PLC 115*p* via a cable. The PLC 115*p* may relay the position measurement of the counterweight assembly 110 to the motor driver 115*m* via a data link. The PLC 115*p* may also utilize measurements from the laser rangefinder 115*t* to determine velocity of the counterweight assembly.

Alternatively, the laser rangefinder 115*t* may be mounted on the crown 7 and the mirror 110*m* may be mounted to the top of the counterweight box 110*b*. Alternatively, the counterweight position sensor may be an ultrasonic rangefinder instead of the laser rangefinder 115*t*. The ultrasonic rangefinder may include a series of units spaced along the tower 111 at increments within the operating range thereof. Each unit may include an ultrasonic transceiver (or separate transmitter and receiver pair) and may detect proximity of the counterweight box 110*b* when in the operating range. Alternatively, the counterweight position sensor may be a string potentiometer instead of the laser rangefinder 115*t*. The potentiometer may include a wire connected to the counterweight box 110*b*, a spool having the wire coiled thereon and connected to the crown 7 or tower base 13, and a rotational sensor mounted to the spool and a torsion spring for maintaining tension in the wire. Alternatively, a linear variable differential transformer (LVDT) may be mounted to the counterweight box 110*b* and a series of ferromagnetic targets may be disposed along the tower 111.

The motor driver 115*m* may be mounted to the skid 5 and be in electrical communication with the stator of the motor 106 via a power cable. The power cable may include a pair of conductors for each phase of the motor 106. The motor driver 115*m* may be variable speed including a rectifier and an inverter. The motor driver 115*m* may receive a three phase alternating current (AC) power signal from a three phase power source, such as a generator or transmission lines. The rectifier may convert the three phase AC power signal to a direct current (DC) power signal and the inverter may modulate the DC power signal to drive each phase of the motor stator based on signals from the laser rangefinder 115*t* and control signals from the PLC 115*p*.

The power converter 115*c* may include a rectifier, a transformer, and an inverter for converting electric power generated by the motor 106 on the downstroke to usable power for storage by the battery 115*b*. The battery 115*b* may then return the stored power to the motor driver 115*m* on the upstroke, thereby lessening the demand on the three phase power source.

Alternatively, the counterweight position may be determined by the motor driver 115*m* having a voltmeter and/or ammeter in communication with each phase of the motor 106. Should the motor 106 be switched reluctance or permanent magnet, at any given time, the motor driver 115*m* may drive only two of the stator phases and may use the voltmeter and/or ammeter to measure back electromotive force (EMF) in the idle phase. The motor driver 115*m* may then use the measured back EMF from the idle phase to determine the position of the counterweight assembly 110.

Figure 9A:
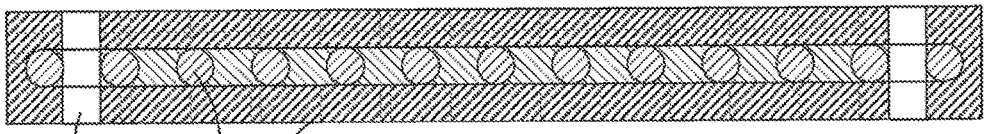
FIGS. 9A and 9B illustrate a load belt of the long-stroke pumping unit.
Figure 9B:
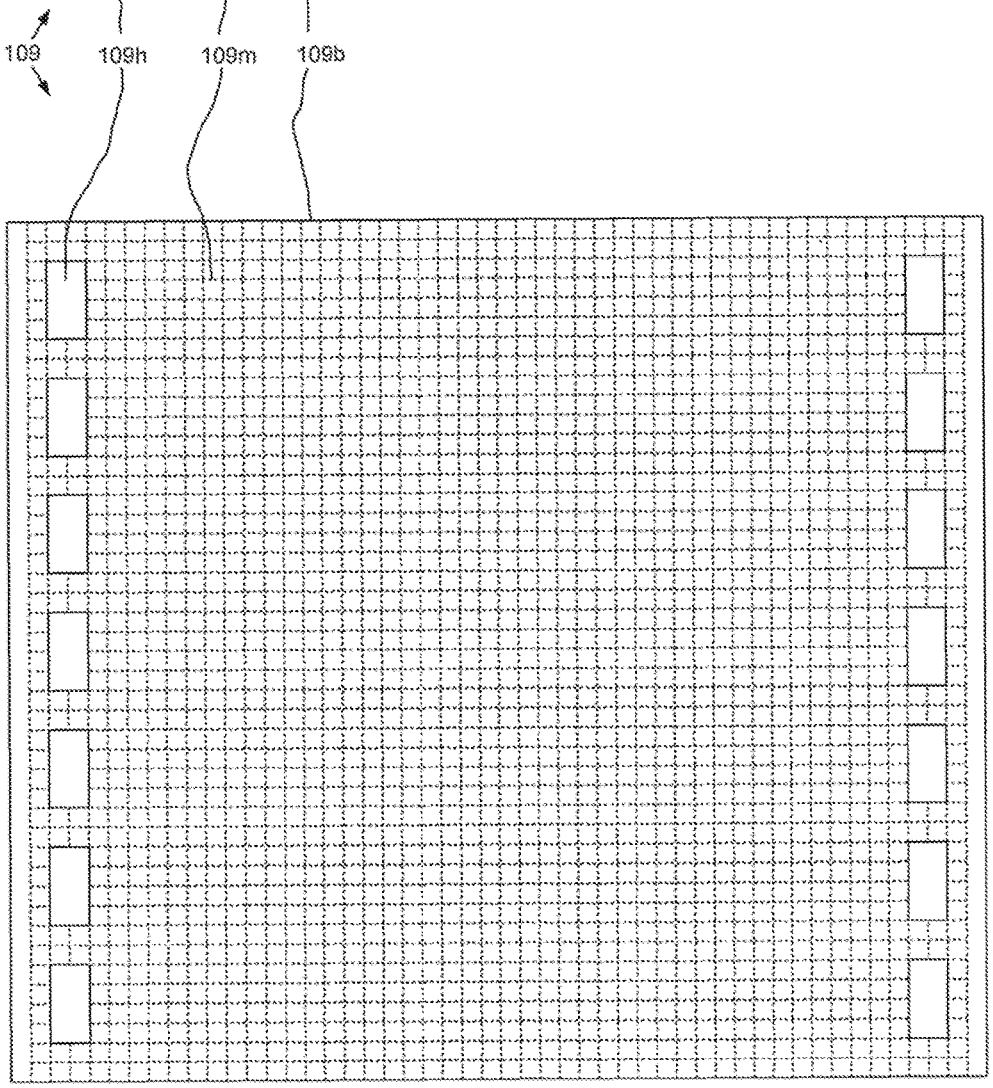

FIGS. 9A and 9B illustrate the load belt 109. The load belt 109 may include a body 109*b* reinforced by a mesh 109*m*. The body 109*b* may be made from an elastomer or elastomeric copolymer. The mesh 109*m* may be disposed in the body 109*b* and extend along a length thereof and across a width thereof. The mesh 109*m* may be made from metal or alloy, such as spring steel wire or rod, or fiber, such as glass, carbon, or aramid (including para-aramids and meta-aramids). The body 109*b* may be molded around and through the mesh 109*m* such that they integrally form the load belt 109. A row of sprocket holes 109*h* may be formed adjacent to and along each edge of the load belt 109. The sprocket holes 109*h* may be cut through the body 109*b* and the mesh 109*m* after the load belt 109 is molded. Each row of sprocket holes 109*h* may mesh with teeth of a respective sprocket 108*k* such that the load belt 109 may be positively driven by the motor 106.

In operation, the motor 106 may be activated by the PLC 115*p* and operated by the motor driver 115*m* to rotate the sprockets 108*k* in both clockwise and counterclockwise directions, thereby reciprocating the counterweight assembly 110 along the tower 111, counter-reciprocating the rod string 1*r* via the load belt 109 connection to both members, driving the downhole pump, and lifting production fluid from the wellbore 2*w* to the wellhead 2*h*.

Should the PLC 115*p* detect failure of the rod string 1*r* by monitoring the laser rangefinder 115*t* and/or the load cell 115*d*, the PLC may instruct the motor driver 115*m* to operate the motor 106 to control the descent of the counterweight assembly 110 until the counterweight assembly reaches the tower base 13. The PLC 115*p* may then shut down the motor 106. The PLC 115*p* may be in data communication with a home office (not shown) via long distance telemetry (not shown). The PLC 115*p* may report failure of the rod string 1*r* to the home office so that a workover rig (not shown) may be dispatched to the well site to repair the rod string 1*r*.

Figure 10A:
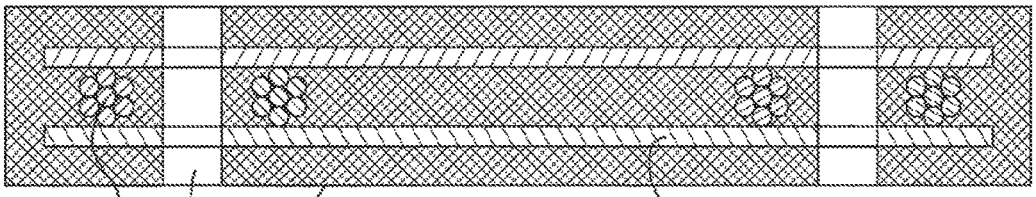
FIGS. 10A and 10B illustrate a first alternative load belt for use with the long-stroke pumping unit instead of the load belt, according to another embodiment of the present disclosure.
Figure 10B:
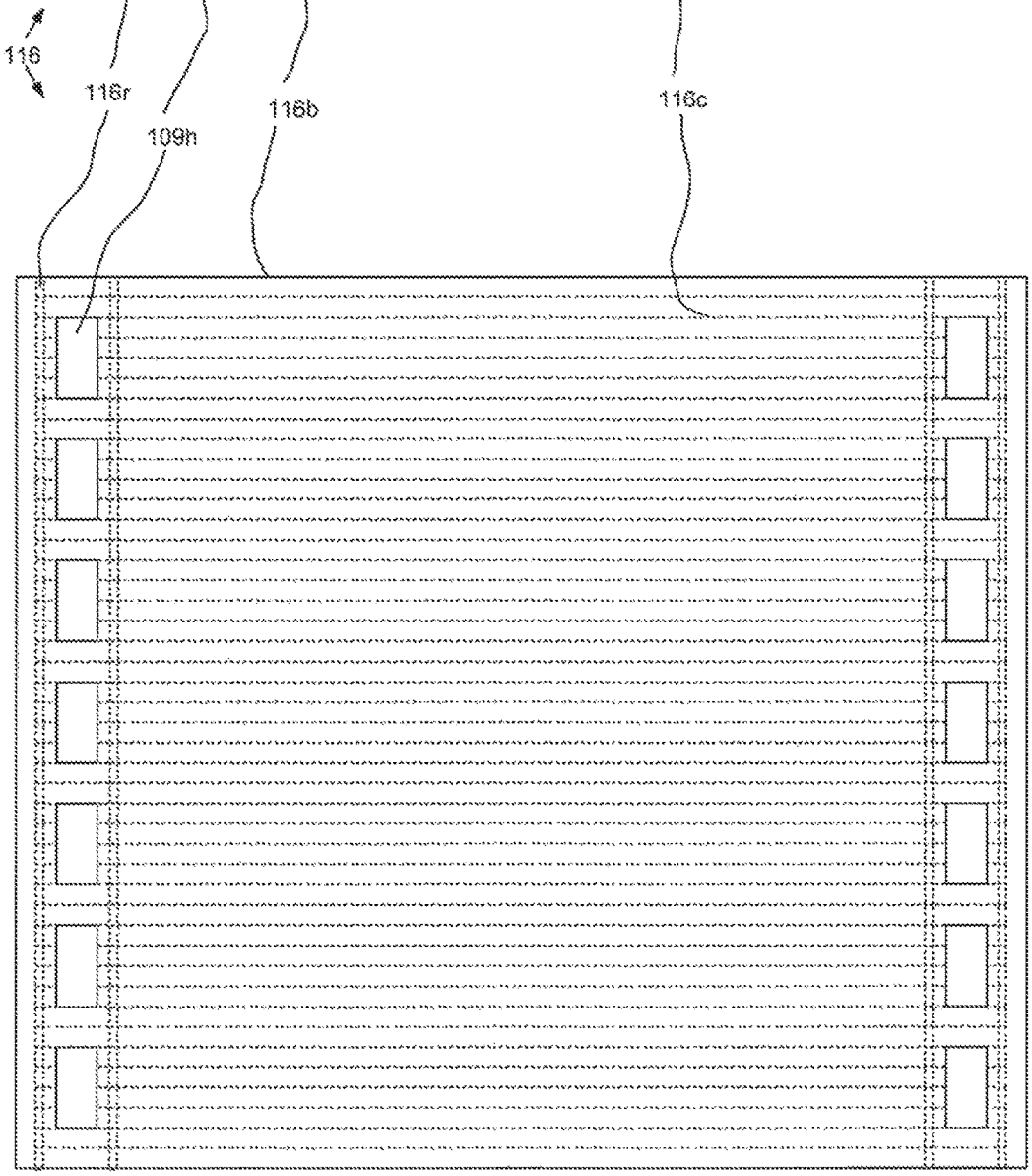

FIGS. 10A and 10B illustrate a first alternative load belt 116 for use with the long-stroke pumping unit 101*k* instead of the load belt 109, according to another embodiment of the present disclosure. The first alternative load belt 116 may include a body 116*b* reinforced by two pairs of ropes 116*r* and one or more (pair shown) plies of cord 116*c*. The body 116*b* may be made from an elastomer or elastomeric copolymer. Each rope 116*r* may be disposed in the body 116*b* and extend along a length thereof. Each pair of ropes 116*r* may be located adjacent to and along each edge of the first alternative load belt 116 and be spaced apart by a distance corresponding to a width of the sprocket holes 109*h*. Each rope 116*r* may be made from woven wire of metal or alloy, such as spring steel, or woven fiber, such as glass, carbon, or aramid (including para-aramids and meta-aramids). Each cord 116*c* may be disposed in the body 116*b* and extend across a width thereof. Each ply may include several cords 116*c* spaced along the length of the body 116*b* and each ply may be located adjacent to a respective top and bottom of the ropes 116*r*. Each cord 116*c* may be made from metal or alloy, such as a single strand of spring steel wire or rod, or a single strand of fiber, such as glass, carbon, or aramid (including para-aramids and meta-aramids).

Alternatively, each cord 116*c* may be woven from multiple strands of wire or fiber.

The body 116*b* may be molded around the ropes 116*r* and cords 116*c* and through the plies such that they integrally form the first alternative load belt 116. Each row of sprocket holes 109*h* may be formed between the respective pair of ropes 116*r* such that the ropes straddle the rows. The sprocket holes 109*h* may be cut through the body 16*b* and the plies of cord 116*c* after the first alternative load belt 116 is molded. Each row of sprocket holes 109*h* may mesh with the teeth of a respective sprocket 108*k* such that the first alternative load belt 116 may be positively driven by the motor 106.

Figure 11:
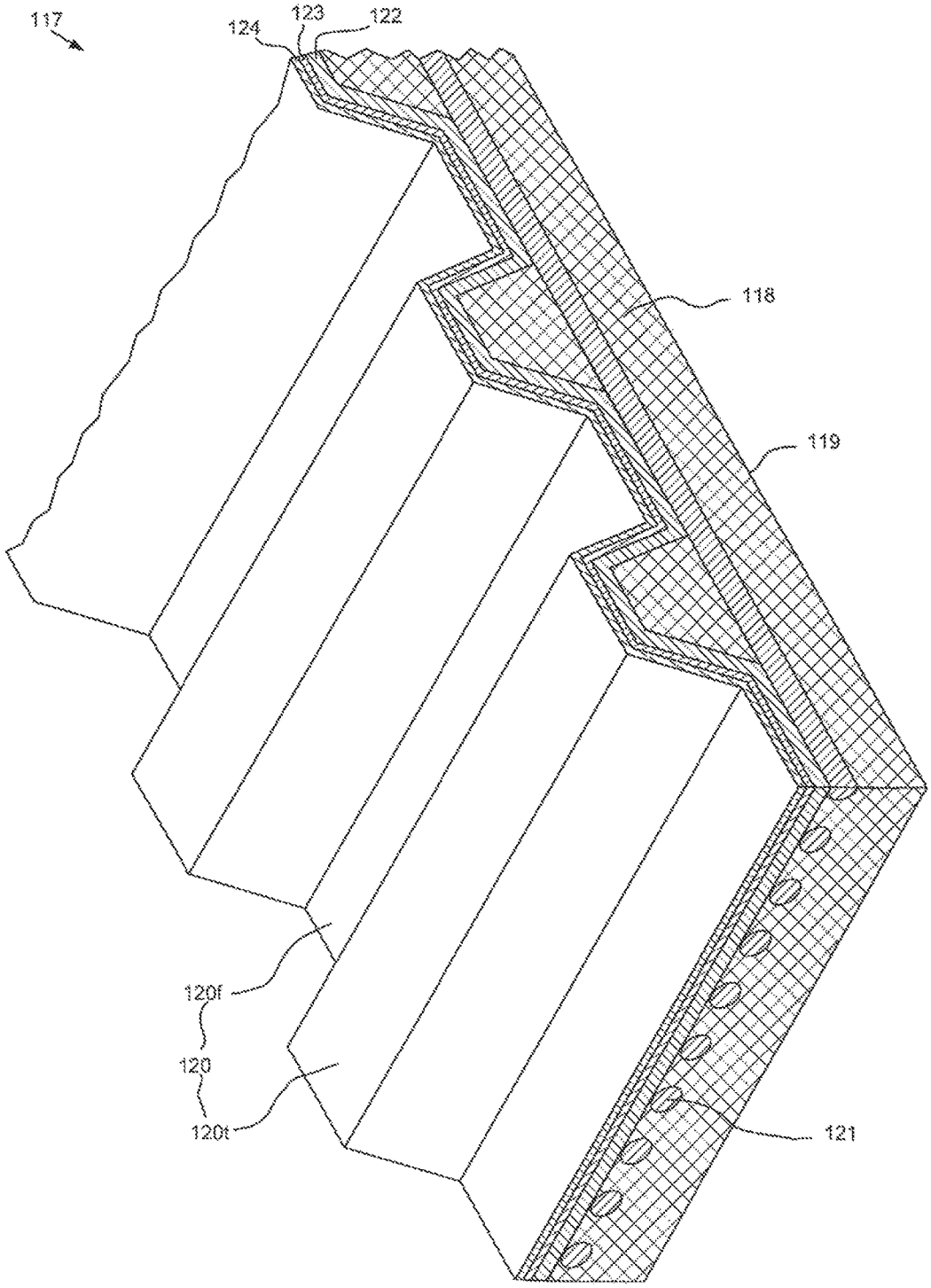
FIG. 11 illustrates a second alternative load belt for use with the long-stroke pumping unit instead of the load belt, according to another embodiment of the present disclosure.

FIG. 11 illustrates a second alternative load belt 117 for use with the long-stroke pumping unit 101*k* instead of the load belt 109, according to another embodiment of the present disclosure. The second alternative load belt 117 may be a timing belt and include a body 118, an outer surface 119, and an inner surface 120. The inner surface 120 may have alternating teeth 120*t* and flats 120*f* and each tooth and flat may extend across a width of the body 118. The body 118 may be made from an elastomer or elastomeric copolymer. The body 118 may be reinforced by a ply of cords 121. Each cord 121 may be disposed in the body 118 adjacent to the inner surface 120 and extend along a length of the body. Each ply may include several cords 121 spaced across the width of the body 118. Each cord 121 may be made from metal or alloy, such as a single strand of spring steel wire or rod, or a single strand of fiber, such as glass, carbon, or aramid (including para-aramids and meta-aramids).

Alternatively, each cord 121 may be woven from multiple strands of wire or fiber.

The teeth 120*t* may be uniformly spaced along the body 118 and have a trapezoidal shape, such as an isosceles trapezoid. The second alternative load belt 117 may further include an abrasion resistance fabric 122, a bonding layer 123, and a cover 124 for reinforcing the inner surface 120. The fabric 122 may be molded into an inner surface of the body 118, the bonding layer 123 applied to the fabric, and the cover 124 laid onto the bonding layer 123 for forming the inner surface 120 of the second alternative load belt 117. The cover 124 may be made from an engineering thermoplastic. The bonding layer 123 may be a polymer selected in order to mechanically bond with the fabric 122 and chemically bond with the cover 124.

Alternatively, the bonding layer 123 may be omitted. Alternatively, either the load belt 109 or the first alternative load belt 116 may be modified to include the fabric 122, bonding layer 123, and/or cover 124.

The belt driver 108 may be modified to accommodate the second alternative load belt 117 by replacing the sprockets 109*k* and drum 108*d* with a single sprocket (not shown) having a length corresponding to the width of the second alternative load belt 117. The single sprocket may be mounted to the drive shaft 108*s* and may have teeth and flats complementing the teeth 120*t* and flats 120*f* to mesh therewith such that the second alternative load belt 117 may be positively driven by the motor 106.

Figure 12:
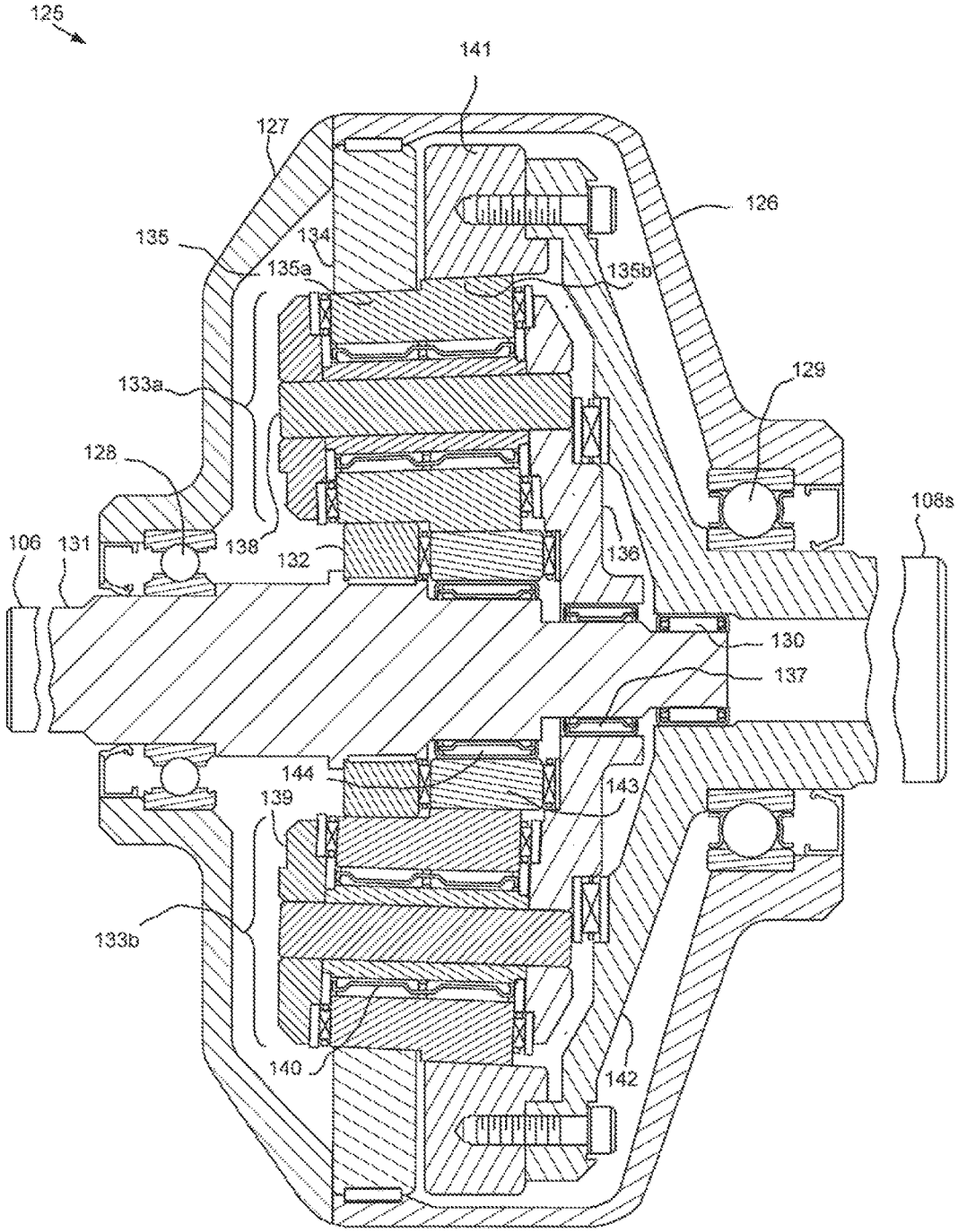
FIG. 12 illustrates a gear box for use with the long-stroke pumping unit, according to another embodiment of the present disclosure.

FIG. 12 illustrates a gear box 125 for use with the long-stroke pumping unit 101*k*, according to another embodiment of the present disclosure. The gear box 125 may be planetary and include a housing 126 and a cover 127 connected thereto, such as by fasteners (not shown). The housing 126 and cover 127 may enclose a lubricant chamber sealed at ends thereof by oil seals. The housing 126 may be mounted to the crown 7 between the motor 106 and the drive shaft 108*s*. The gear box 125 may further include an input shaft 131 extending from a first end of the lubricant chamber and torsionally connected to the rotor of the motor 106 by mating profiles (not shown), such as splines, formed at adjacent ends of the rotor and input shaft. The gear box 125 may further include an output disk 142 having a hub extending from a second end of the lubricant chamber and torsionally connected to the drive shaft 108*s* by mating profiles (not shown), such as splines, formed at adjacent ends of the hub and drive shaft.

Each of the input shaft 131 and output disk 142 may be radially supported from the respective cover 127 and housing 126 for rotation relative thereto by respective bearings 128, 129. The hub of the output disk 142 may receive an end of the input shaft 121 and a needle bearing 130 may be disposed therebetween for supporting the input shaft therefrom while allowing relative rotation therebetween. A sun gear 132 may be disposed in the lubricant chamber and may be mounted onto the input shaft 131. A stationary housing gear 134 may be disposed in the lubricant chamber and mounted to the housing 126. A plurality of planetary rollers 133*a,b* may also be disposed in the lubricant chamber.

Each planetary roller 133*a,b* may include a planetary gear 135 disposed between and meshed with the sun gear 132 and the housing gear 134. The planetary gears 135 may be linked by a carrier 136 which may be radially supported from the input shaft 131 by a bearing 137 to allow relative rotation therebetween. Each planetary roller 133*a,b* may further include a support shaft 138 which is supported at its free end by a support ring 139 and on which the respective planetary gear 135 may be supported by a bearing 140. Each planetary gear 135 may include first 135*a* and second 135*b* sections of different diameters, the first section 135*a* meshing with the housing gear 134 and the sun gear 132 and the second section 135*b* meshing with an output gear 141 and a support gear 143. The output gear 141 may be mounted to the output disk 142 by fasteners. The support gear 143 may be radially supported from the input shaft 131 by a bearing 144 to allow relative rotation therebetween.

The support shafts 138 may be arranged at a slight angle with respect to longitudinal axes of the input shaft 131 and output disk 142. The planetary gears 135, housing gear 134, output gear 141, and support gear 143 may also be slightly conical so that, upon assembly of the gear box 125, predetermined traction surface contact forces may be generated. The gear box 125 may further include assorted thrust bearings disposed between various members thereof.

In operation, rotation of the input shaft 131 by the motor 106 may drive the planetary gears 135 via the sun gear 132 to roll along the housing gear 134 while also driving the output gear 141. Since the diameter of the second section 135*b* of each planetary gear 135 may be significantly greater than that of the first section 135*a*, the circumferential speed of the second section 135*b* may correspondingly be significantly greater than that of the first section 135*a*, thereby providing for a speed differential which causes the output gear 141 to counter-rotate at a slower speed corresponding to the difference in diameter between the planetary gear sections. Driving torque of the output gear 141 is also amplified accordingly.

Alternatively, the diameter of the first section 135*a* of each planetary gear 135 may be greater in diameter than that of the second section 135*b* resulting in rotation of the output gear 141 in the same direction as the input shaft 131 again at a speed corresponding to the difference in diameter between the two sections.

In another alternative (not shown) of the long-stroke pumping unit 101*k*, instead of a sprocket and sprocket holes, the drum may have gripping elements embedded in an outer surface thereof and the load belt may have gripping elements embedded in an inner surface thereof.

Figure 13A:
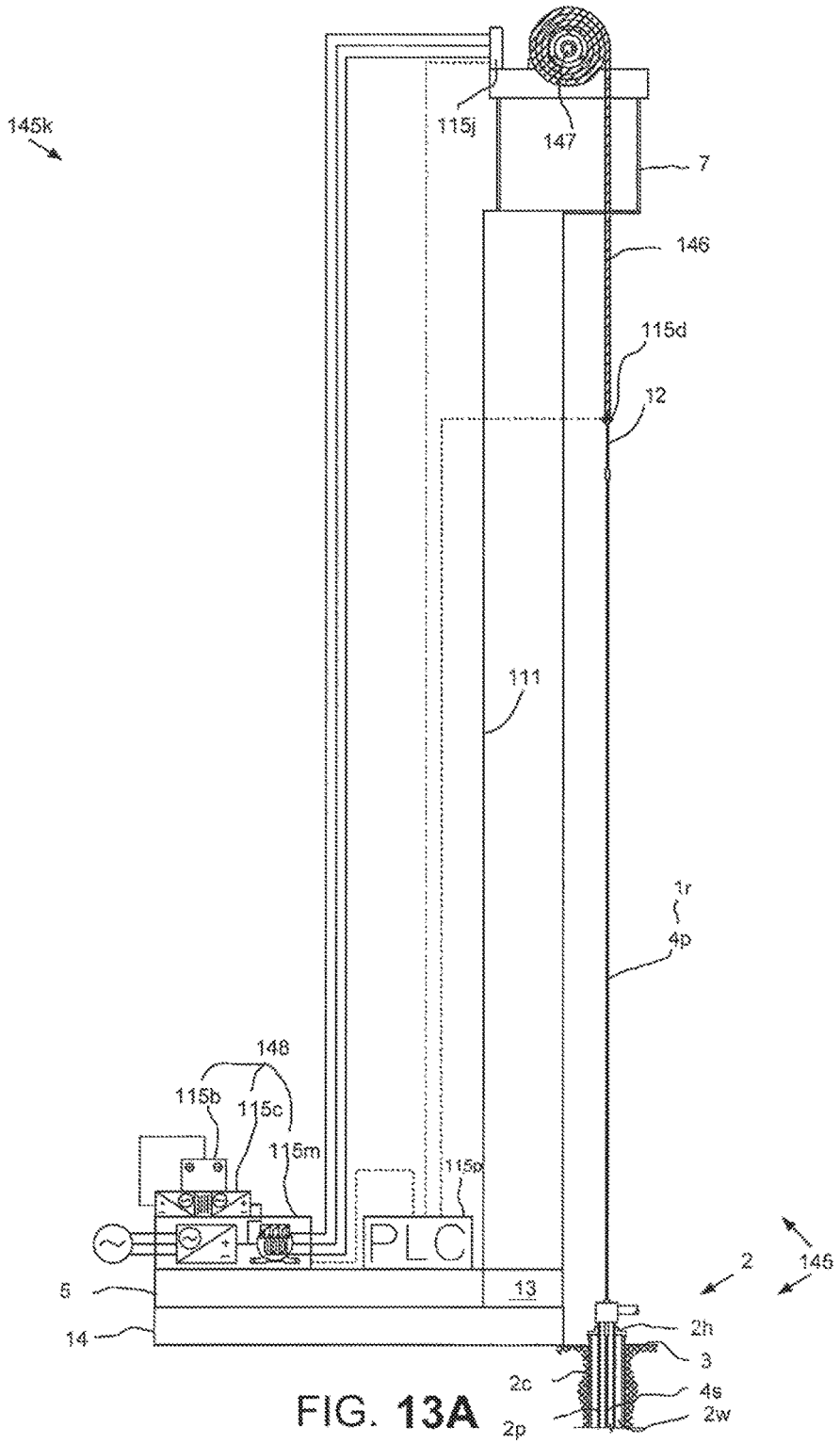
FIGS. 13A and 13B illustrate an alternative long-stroke pumping unit, according to another embodiment of the present disclosure.
Figure 13B:
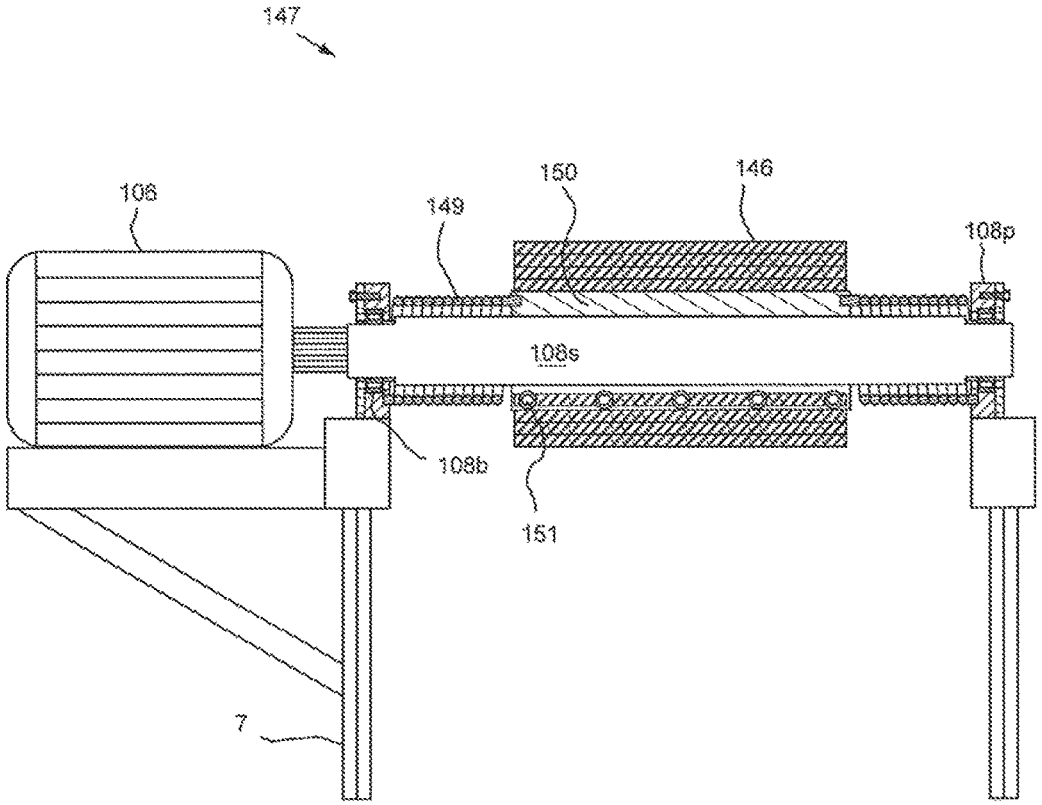

FIGS. 13A and 13B illustrate an alternative long-stroke pumping unit 145*k*, according to another embodiment of the present disclosure. The long-stroke pumping unit 145*k* may be part of an artificial lift system 145 further including the rod string 1*r* and the downhole pump (not shown). The alternative long-stroke pumping unit 145*k* may include the skid 5, the motor, one or more ladders and platforms (not shown), a standing strut (not shown), the crown 7, the wind guards (not shown), the tower 111, the hanger bar 12, the tower base 13, the foundation 14, a load belt 146, a belt reel 147, and a control system 148. The control system 148 may include the PLC 115*p*, the motor driver 115*m*, the load cell 115*d*, the power converter 115*c*, the battery 115*b*, a turns counter (not shown), and the motor junction 115*j*.

The belt reel 147 may include one or more (pair shown) torsion springs 149, the drive shaft 108*s*, a spool 150, the pillow blocks 108*p* mounted to the crown 7, and the bearings 108*b* for supporting the drive shaft from the pillow blocks while accommodating rotation of the drive shaft relative to the pillow blocks. Each torsion spring 149 may be wrapped around the drive shaft 108*s* and have one end connected to a respective pillow block 108*p* and the other end connected to the spool 150. The load belt 146 may have an upper end mounted to the spool 150, such as by fasteners 151, and a lower end longitudinally connected to the hanger bar 12, such as by wire rope. The load belt 146 may be similar to the load belt 109 except for omission of the sprocket holes 109*h*. The load belt 146 may be wrapped around the spool 150, such as for multiple revolutions (depending on position in the pumping cycle), and extend downward to the hanger bar 12.

To raise the rod string 1*r* to a top of the upstroke (shown), the motor 106 may be operated to rotate the spool 150, thereby wrapping the load belt 146 onto the spool. To lower the rod string 1*r* to a bottom of the downstroke (not shown, see FIG. 8A), the motor 106 may be reversed to counter-rotate the spool 150, thereby unwrapping the load belt 146 from the spool. The torsion springs 149 may be oriented to bias the spool 150 toward wrapping of the load belt 146 thereon, thereby mimicking the counterweight assembly 110.

Alternatively, the belt reel 147 may include the gear box 125 disposed between the motor 106 and the drive shaft 108*s*.

The turns counter may include a turns gear torsionally connected to the drive shaft 108*s* and a proximity sensor connected one of the pillow blocks or crown 7 and located adjacent to the turns gear. The turns gear may be made from an electrically conductive metal or alloy and the proximity sensor may be inductive. The proximity sensor may include a transmitting coil, a receiving coil, an inverter for powering the transmitting coil, and a detector circuit connected to the receiving coil. A magnetic field generated by the transmitting coil may induce an eddy current in the turns gear. The magnetic field generated by the eddy current may be measured by the detector circuit and supplied to the PLC 115*p* via the motor junction 115*j*. The PLC 115*p* may then convert the measurement to angular movement and determine a position of the hanger bar 12 relative to the tower 111. The PLC 115*p* may also relay the angular movement determination to the motor controller 115*m*.

Alternatively, the proximity sensor may be Hall effect, ultrasonic, or optical. Alternatively, any of the counterweight position sensors discussed above for the pumping unit 101*k* may be adapted for use with the pumping unit 145*k* to determine the position of the hanger bar 12.

In one embodiment, a pumping unit includes a prime mover for reciprocating a rod string; and a dynamic control system for controlling a speed of the prime mover. The control system includes a load cell for measuring force exerted on the rod string; a sensor for detecting position of the rod string; an accelerometer for measuring vibration of the rod string or of a production string; a meter for measuring power consumed by the prime mover; and a controller. The controller is operable to solve a wave equation to deduce position of and load on a downhole pump connected to the rod string and the production string; determine acceptability of two or more parameters of the pumping unit; select a prime objective based on a hierarchy of the parameters and the acceptability of the parameters; and determine an upstroke speed, a downstroke speed, and turnaround accelerations and decelerations for the prime objective.

In one embodiment, a pumping unit includes a prime mover for reciprocating a rod string; and a dynamic control system for controlling a speed of the prime mover. The control system includes a load cell for measuring force exerted on the rod string; a sensor for detecting position of the rod string; an accelerometer for measuring vibration of the rod string or of a production string; a meter for measuring power consumed by the prime mover; and a controller. The controller is operable to determine position of and load on a downhole pump connected to the rod string and the production string; determine acceptability of two or more parameters of the pumping unit; select a prime objective based on a hierarchy of the parameters and the acceptability of the parameters; and determine an upstroke speed, a downstroke speed, and turnaround accelerations and decelerations for the prime objective.

In one or more of the embodiments described herein, the two or more parameters are selected from a group consisting of: production rate, efficiency, fillage of the downhole pump, fluid level of the downhole pump, static and dynamic stress of the rod string, torque and torque factor of the prime mover, vibration of the rod string, vibration of the production string, reciprocation speed of the rod string, fluid velocity in the production string, drag of production fluid on the rod string, and gas-oil ratio of the production fluid.

In one or more of the embodiments described herein, the accelerometer is integrated within the load cell for measuring the vibration of the rod string.

In one or more of the embodiments described herein, the accelerometer is mounted on a tubular body for assembly as part of the production string.

In one or more of the embodiments described herein, the accelerometer is a dual axis microelectromechanical system.

In one or more of the embodiments described herein, the prime mover is an electric three phase motor, and the dynamic control system further comprises a three phase variable speed motor driver.

In one or more of the embodiments described herein, the pumping also includes at least one of a tower; a counterweight assembly movable along the tower; a crown mounted atop the tower; a belt having a first end connected to the counterweight assembly and having a second end connectable to the rod string, wherein the sensor is operable to detect a position of the rod string by detecting a position of the counterweight assembly.

In one or more of the embodiments described herein, the sensor is an ultrasonic rangefinder comprising a long range transducer and a short range transducer.

In one or more of the embodiments described herein, the sensor is a linear variable differential transformer (LVDT) having a string connected to the counterweight assembly and wound onto a spool; a screw shaft engaged with a thread of the spool; an LVDT core mounted to the screw shaft; and an LVDT body at least partially receiving the LVDT core.

In one or more of the embodiments described herein, the controller is further operable to monitor for failure of the rod string or load belt and control descent of the counterweight assembly in response to detection of the failure.

In one or more of the embodiments described herein, the pumping unit includes a drive sprocket torsionally connected to the prime mover; an idler sprocket connected to the tower; a chain for orbiting around the sprockets; and a carriage for longitudinally connecting the counterweight assembly to the chain while allowing relative transverse movement of the chain relative to the counterweight assembly.

In one or more of the embodiments described herein, the pumping unit includes a drum supported by the crown and rotatable relative thereto, wherein the belt extends over the drum.

In one or more of the embodiments described herein, the controller is a programmable logic controller, application-specific integrated circuit, or field-programmable gate array.

In one or more of the embodiments described herein, the controller is further operable to monitor for failure or imminent failure of the pumping unit and to shut down the pumping unit in response to detection of the failure or imminent failure.

In one or more of the embodiments described herein, the controller is further operable to monitor for failure or imminent failure of the pumping unit and to operate the pumping unit using an emergency hierarchy and emergency acceptability values in response to detection of the failure or imminent failure.

In another embodiment, a long-stroke pumping unit includes a tower; a crown mounted atop the tower; a spool supported by the crown and rotatable relative thereto; and a belt. The belt has an upper end mounted to the spool, is wrapped around the spool, and has a lower end connectable to a rod string. The unit further includes a motor having a stator mounted to the crown and a rotor torsionally connected to the spool; and a torsion spring having one end connected to the crown and the other end connected to the spool for biasing the spool toward wrapping of the belt thereon.

In another embodiment, a long-stroke pumping unit includes a tower; a counterweight assembly movable along the tower; a crown mounted atop the tower; a sprocket supported by the crown and rotatable relative thereto; and a belt. The belt has a first end connected to the counterweight assembly, extends over and meshes with the sprocket, and has a second end connectable to a rod string. The unit further includes a motor having a stator mounted to the crown and a rotor torsionally connected to the sprocket; and a sensor for detecting position of the counterweight assembly.

In one or more of the embodiments described herein, the pumping unit further includes a second sprocket and a drum, each supported by the crown and rotatable relative thereto, wherein the sprockets straddle the drum.

In one or more of the embodiments described herein, the belt includes a body made from an elastomer or elastomeric copolymer; a mesh disposed in the body and extending along a length thereof and across a width thereof; and two rows of sprocket holes, each row formed adjacent to and along a respective edge of the belt and each hole formed through the body and the mesh.

In one or more of the embodiments described herein, the belt includes a body made from an elastomer or elastomeric copolymer; a ply of cords disposed in the body, each cord extending across a width thereof; two rows of sprocket holes, each row formed adjacent to and along a respective edge of the belt and each hole formed through the body and the plies; and two pairs of ropes disposed in the body, each rope extending along a length thereof and each pair straddling the sprocket holes.

In one or more of the embodiments described herein, the belt further comprises a second ply of cords disposed in the body, each cord extending across the width thereof, and each ply is located adjacent to a respective top and bottom of the ropes.

In one or more of the embodiments described herein, the belt includes a body made from an elastomer or elastomeric copolymer; alternating teeth and flats, each tooth and each flat formed across an inner surface of the body; and a ply of cords disposed in the body adjacent to the inner surface, each cord extending along a length thereof.

In one or more of the embodiments described herein, the belt further includes a fabric molded into the inner surface of the body; and a cover made from an engineering thermoplastic and bonded to the fabric.

In one or more of the embodiments described herein, the pumping unit includes a gear box torsionally connecting the rotor to the sprocket.

In one or more of the embodiments described herein, the gear box is planetary.

In one or more of the embodiments described herein, the sensor is a laser rangefinder, ultrasonic rangefinder, string potentiometer, or linear variable differential transformer (LVDT).

In one or more of the embodiments described herein, the motor is an electric three phase motor.

In one or more of the embodiments described herein, the pumping unit includes a variable speed motor driver in electrical communication with the motor; and a controller in data communication with the motor driver and the sensor and operable to control speed thereof.

In one or more of the embodiments described herein, the controller is further operable to monitor the sensor for failure of the rod string and instruct the motor driver to control descent of the counterweight assembly in response to detection of the failure.

In one or more of the embodiments described herein, the pumping unit includes a power converter in electrical communication with the motor driver; and a battery in electrical communication with the power converter and operable to store electrical power generated by the motor during a downstroke of the pumping unit.

In one or more of the embodiments described herein, the electric motor is a switched reluctance or permanent magnet motor.

In one or more of the embodiments described herein, the pumping unit includes a gear box torsionally connecting the rotor to the spool.

In one or more of the embodiments described herein, the pumping unit includes a sensor for detecting position of the lower end of the belt, a variable speed motor driver in electrical communication with the motor; and a controller in data communication with the motor driver and the sensor and operable to control speed thereof.

While the foregoing is directed to embodiments of the present disclosure, other and further embodiments of the disclosure may be devised without departing from the basic scope thereof, and the scope of the invention is determined by the claims that follow.

The invention claimed is:

1. A pumping unit, comprising:
- a prime mover for reciprocating a rod string;
- a tower;
- a counterweight assembly movable along the tower;
- a crown mounted atop the tower;
- a belt having a first end connected to the counterweight assembly and having a second end connectable to the rod string; and
- a dynamic control system for controlling a speed of the prime mover and comprising:
  - a load cell for measuring force exerted on the rod string;
  - a sensor for detecting position of the rod string, wherein the sensor is operable to detect a position of the rod string by detecting a position of the counterweight assembly;
  - an accelerometer for measuring vibration of the rod string or of a production string;
  - a meter for measuring power consumed by the prime mover; and
  - a controller operable to:
    - determine position of and load on a downhole pump connected to the rod string and the production string;
    - determine acceptability of two or more parameters of the pumping unit;
    - select a prime objective based on a hierarchy of the parameters and the acceptability of the parameters;
    - determine an upstroke speed, a downstroke speed, and turnaround accelerations and decelerations for the prime objective; and
    - monitor for failure of the rod string or belt and control descent of the counterweight assembly in response to detection of the failure.

2. The unit of claim 1, wherein the accelerometer is integrated within the load cell for measuring the vibration of the rod string.

3. The unit of claim 1, wherein the accelerometer is a dual axis microelectromechanical system.

4. The unit of claim 1, wherein the sensor is an ultrasonic rangefinder comprising a long range transducer and a short range transducer.

5. The unit of claim 1, wherein the sensor is a linear variable differential transformer (LVDT) comprising:
- a string connected to the counterweight assembly and wound onto a spool;
- a screw shaft engaged with a thread of the spool;
- an LVDT core mounted to the screw shaft; and
- an LVDT body at least partially receiving the LVDT core.

6. The unit of claim 1, wherein the controller is further operable to monitor for failure or imminent failure of the pumping unit and to:
- a. shut down the pumping unit in response to detection of the failure or imminent failure, or
- b. operate the pumping unit using an emergency hierarchy and emergency acceptability values in response to detection of the failure or imminent failure.

7. The unit of claim 1, wherein the two or more parameters are selected from a group consisting of: production rate, efficiency, fillage of the downhole pump, fluid level of the downhole pump, static and dynamic stress of the rod string, torque and torque factor of the prime mover, vibration of the rod string, vibration of the production string, reciprocation speed of the rod string, fluid velocity in the production string, drag of production fluid on the rod string, and gas-oil ratio of the production fluid.

8. The unit of claim 1, wherein the accelerometer is mounted on a tubular body for assembly as part of the production string.

9. The unit of claim 1, wherein:
- the prime mover is an electric three phase motor, and
- the dynamic control system further comprises a three phase variable speed motor driver.

10. The unit of claim 1, further comprising
- a drive sprocket torsionally connected to the prime mover;
- an idler sprocket connected to the tower;
- a chain for orbiting around the sprockets; and
- a carriage for longitudinally connecting the counterweight assembly to the chain while allowing relative transverse movement of the chain relative to the counterweight assembly.

11. The unit of claim 1, further comprising a drum supported by the crown and rotatable relative thereto, wherein the belt extends over the drum.

12. The unit of claim 11, wherein the accelerometer is integrated within the load cell for measuring the vibration of the rod string.

13. The unit of claim 12, wherein the sensor is an ultrasonic rangefinder comprising a long range transducer and a short range transducer.

14. The unit of claim 13, further comprising
- a drive sprocket torsionally connected to the prime mover;
- an idler sprocket connected to the tower;
- a chain for orbiting around the sprockets; and
- a carriage for longitudinally connecting the counterweight assembly to the chain while allowing relative transverse movement of the chain relative to the counterweight assembly.

15. The unit of claim 1, wherein the controller is a programmable logic controller, application-specific integrated circuit, or field-programmable gate array.

16. A pumping unit, comprising:
- a prime mover for reciprocating a rod string;
- a tower;

a counterweight assembly movable along the tower;

a crown mounted atop the tower;

a belt having a first end connected to the counterweight assembly and having a second end connectable to the rod string; and a dynamic control system for controlling a speed of the prime mover and comprising:

a load cell for measuring force exerted on the rod string;

a sensor for detecting position of the rod string, wherein the sensor is operable to detect a position of the rod string by detecting a position of the counterweight assembly and wherein the sensor is a linear variable differential transformer (LVDT) comprising:

a string connected to the counterweight assembly and wound onto a spool;

a screw shaft engaged with a thread of the spool;

an LVDT core mounted to the screw shaft; and an LVDT body at least partially receiving the LVDT core;

an accelerometer for measuring vibration of the rod string or of a production string;

a meter for measuring power consumed by the prime mover; and a controller operable to:

determine position of and load on a downhole pump connected to the rod string and the production string;

determine acceptability of two or more parameters of the pumping unit;

select a prime objective based on a hierarchy of the parameters and the acceptability of the parameters; and determine an upstroke speed, a downstroke speed, and turnaround accelerations and decelerations for the prime objective.

17. The unit of claim 16, wherein the accelerometer is integrated within the load cell for measuring the vibration of the rod string.

18. The unit of claim 17, wherein the sensor is an ultrasonic rangefinder comprising a long range transducer and a short range transducer.

19. The unit of claim 18, further comprising a drive sprocket torsionally connected to the prime mover;

an idler sprocket connected to the tower;

a chain for orbiting around the sprockets; and a carriage for longitudinally connecting the counterweight assembly to the chain while allowing relative transverse movement of the chain relative to the counterweight assembly.

* * * * *